US009696116B2

(12) United States Patent
Hamilton et al.

(10) Patent No.: US 9,696,116 B2
(45) Date of Patent: Jul. 4, 2017

(54) SYSTEM AND METHOD FOR PRODUCING A DOPE CHART

(71) Applicant: Sheltered Wings, Inc., Middleton, WI (US)

(72) Inventors: David M. Hamilton, Mont Horeb, WI (US); Dan Schumann, Middleton, WI (US)

(73) Assignee: Sheltered Wings, Inc., Middleton, WI (US)

( * ) Notice: Subject to any disclaimer, the term of this patent is extended or adjusted under 35 U.S.C. 154(b) by 0 days.

(21) Appl. No.: 14/752,341

(22) Filed: Jun. 26, 2015

(65) Prior Publication Data

US 2015/0316353 A1 Nov. 5, 2015

Related U.S. Application Data

(63) Continuation-in-part of application No. 14/196,251, filed on Mar. 4, 2014.

(51) Int. Cl.
*F41G 1/38* (2006.01)
*F41G 3/08* (2006.01)
*F41G 1/473* (2006.01)

(52) U.S. Cl.
CPC ..... *F41G 3/08* (2013.01); *F41G 1/383* (2013.01); *F41G 1/473* (2013.01)

(58) Field of Classification Search
CPC . F41G 11/00; F41G 1/00; F41G 1/473; F41G 1/38; F41G 1/54; F41G 1/383; F41G 3/08; G01C 23/00
USPC ..... 42/90, 129, 111, 119, 122; 33/228
See application file for complete search history.

(56) References Cited

U.S. PATENT DOCUMENTS 4,734,989 A * 4/1988 Sanders ..... F41G 1/04 42/137
5,299,113 A * 3/1994 England ..... G05B 19/042 700/17
5,375,072 A * 12/1994 Cohen ..... F41G 3/06 235/414
5,960,576 A * 10/1999 Robinson ..... G06G 1/0057 42/142
6,516,699 B2 * 2/2003 Sammut ..... F41G 1/38 42/122
6,862,832 B2 * 3/2005 Barrett ..... F41G 1/38 42/119
7,162,825 B2 * 1/2007 Ugolini ..... F41G 1/54 33/228

(Continued)

OTHER PUBLICATIONS

AR15.com Official Mk12 Mod0, Mod1, ModH Photoo and Discussion Thread pp. 1-11, posted Jul. 29, 2011.*

*Primary Examiner* — Benjamin P Lee
(74) *Attorney, Agent, or Firm* — Husch Blackwell LLP

(57) ABSTRACT

A cover for use with an optic device to hold and display shooting information. The cover may have resilient retention members that allow a display to be releasably attached and detached from the cover. The display may be made from a single substrate or multiple substrates in order to make the shooting information contained thereon highly visible in a variety of conditions and shooting preferences. The display may further be customized by a user to include desired DOPE information and then printed onto the single or multiple substrates. A system and method for creating custom DOPE charts is also provided.

22 Claims, 23 Drawing Sheets

(56) References Cited

U.S. PATENT DOCUMENTS

| | | | | |
|---|---|---|---|---|
| 7,832,137 | B2 * | 11/2010 | Sammut | F41G 1/473 235/404 |
| 7,937,878 | B2 * | 5/2011 | Sammut | F41G 1/473 42/122 |
| 8,001,714 | B2 * | 8/2011 | Davidson | F41G 1/38 42/122 |
| 8,281,995 | B2 * | 10/2012 | Bay | F41G 3/06 235/414 |
| 8,353,454 | B2 * | 1/2013 | Sammut | F41G 1/38 235/404 |
| 8,656,630 | B2 * | 2/2014 | Sammut | F41G 1/38 42/122 |
| 8,701,330 | B2 * | 4/2014 | Tubb | F41G 1/38 33/297 |
| 8,739,672 | B1 * | 6/2014 | Kelly | F41G 3/02 89/1.11 |
| 8,893,423 | B2 * | 11/2014 | Tubb | F41G 1/38 42/122 |
| 9,121,672 | B2 * | 9/2015 | Tubb | F41G 1/473 |
| 2007/0137088 | A1 * | 6/2007 | Peters | F41G 1/473 42/111 |
| 2007/0188488 | A1 * | 8/2007 | Choi | G06T 15/005 345/419 |
| 2011/0168777 | A1 * | 7/2011 | Bay | F41G 3/06 235/414 |
| 2012/0186130 | A1 * | 7/2012 | Tubb | F41G 1/38 42/122 |
| 2014/0110482 | A1 * | 4/2014 | Bay | F41G 1/38 235/404 |

* cited by examiner

SYSTEM AND METHOD FOR PRODUCING A DOPE CHART

CROSS REFERENCE TO RELATED APPLICATION

This application is a continuation-in-part of U.S. patent application Ser. No. 14/196,251, filed Mar. 4, 2014, which is incorporated herein by reference for all purposes.

FIELD OF THE INVENTION

The present invention relates generally to the field of optic sighting devices. More particularly, the present invention relates to a system and method for producing custom DOPE charts.

BACKGROUND OF THE INVENTION

Avid shooters, e.g. hunters, competition shooters, military personnel, law enforcement officers, etc., rely on many different pieces of information in order to make accurate and precise shots. Some of the information relied upon by shooters is based upon environmental factors such as distance, minute of angle, elevation hold value, wind hold value, pressure, temperature, or elevation. Some information is based upon the equipment being used, for example scope height, muzzle velocity, and/or the ballistic being used, for example bullet class, bullet speed, bullet's ballistic coefficient and bullet drag model, or a combination of these parameters, such as observed bullet drop. This information is commonly referred to in the shooting industry as Data On Personal Equipment, Data On Previous Engagements, or "DOPE."

Due to the amount of different DOPE values that can affect the precision and accuracy of a shot and the variability of the same, keeping track of such DOPE values can be challenging for shooters. Some shooters use hand-written log books to enter the information themselves. Other shooters may use a number of pre-calculated DOPE charts from which a shooter can look up the information needed, however many shooters do not use such pre-calculated charts because they are tied to what a particular gun/ammo combination should produce, but every gun shoots slightly differently. Furthermore, if the user changes either the gun or ammo being used, the chart is useless. Furthermore, shooters often cut portions of their hand-written logs or books into a circular or disc shape and taping or gluing them to the inside of their optic covers. Such hand-written logs suffer from diminished legibility and information density limitations, which often prove problematic, particularly if a shooter needs to use the DOPE information in less than ideal conditions, such as at night, in inclement weather, or in high stress military or hunting environments. Humans simply cannot hand-write legible characters as small as a printer can print.

Many shooters use an optical device such as, but not limited to a scope, when shooting. In order to protect the lenses of the optical device from scratches, shooters will often use covers. Some covers, called flip cap or flip open covers, fit on the end(s) of the optical device and have a cap that can be closed when the optical device is not in use or opened when the shooter intends on using the optical device. When the flip cap is open, the eyepiece of the optical device is available for use by the shooter with the cover's cap off to the side or above the optical device. Since the inside of the cover's cap is available for use and faces the shooter when the cover is open, the inside of the cap is a convenient place to hold a shooter's DOPE chart.

One company called Scope Dope states that it offers "a quick reference ballistic data disc designed to fit inside the cover of a 'flip-open' riflescope cap . . . made from heavy die cut vinyl." Scope Dope also states that a shooter can then "pre-record critical data using the waterproof permanent pen onto the data disc." The discs offered by Scope Dope can be attached to a cap by using glue or tape. While Scope Dope's products provide a circular form factor that fits inside a riflescope cap, the shooter must still hand write the DOPE values into the chart, so legibility and information density remains a concern.

As such, there is a need for a system and method that allows a shooter to input certain information or parameters, such as environmental information, gun information, and ammunition information (including custom ammunition), or a combination of such information or parameters, which the system processes to generate a custom DOPE chart in an identified format. That DOPE chart may then be produced in a highly legible, durable, and waterproof DOPE chart display that is removable and replaceable in a scope cap.

SUMMARY OF THE INVENTION

The present invention relates to a system for producing a DOPE chart for use with an optical device such as a rifle scope. The system includes a user computer displaying a configuration interface. The configuration interface may be accessed via a website or alternatively via software stored locally on the user computer. The configuration interface provides a user with a plurality of options from which to choose. The options provided to the user are controlled by a DOPE chart configuration database to which the configuration interface is connected either via the internet, local network, or the database may also be stored locally on the user computer. Finally, the system includes a printer or engraver that allows the user to convert the DOPE chart from a configuration shown on the configuration interface to a physical DOPE chart that he or she can take shooting.

The present invention also relates to a method for using the system described above. The method includes the step of providing a user with a configuration interface. At least one server is provided that stores and processes data related to the DOPE chart configuration system. The user selects from a plurality of options presented to him or her on the configuration interface. The plurality of options may include items such as, but not limited to, DOPE chart style, DOPE values, graphics, custom text, etc. The user may also enter at least one desired DOPE value into a DOPE chart configuration table displayed on the DOPE chart configurator display. The DOPE chart configurator display may also include a real-time preview of the DOPE chart configuration. Once the user has completed his or her DOPE chart configuration, he or she can order the production of the DOPE chart configuration.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

A cover for an optic device in accordance with the present invention helps shooters conveniently and securely releasably retain shooting information on a cap of the optic cover. A display in accordance with the present invention can be securely attached to and detached from the cap of an optic cover to readily display shooting information. The present invention also provides a system and method for creating and producing displays using a computer.

Figure 1:
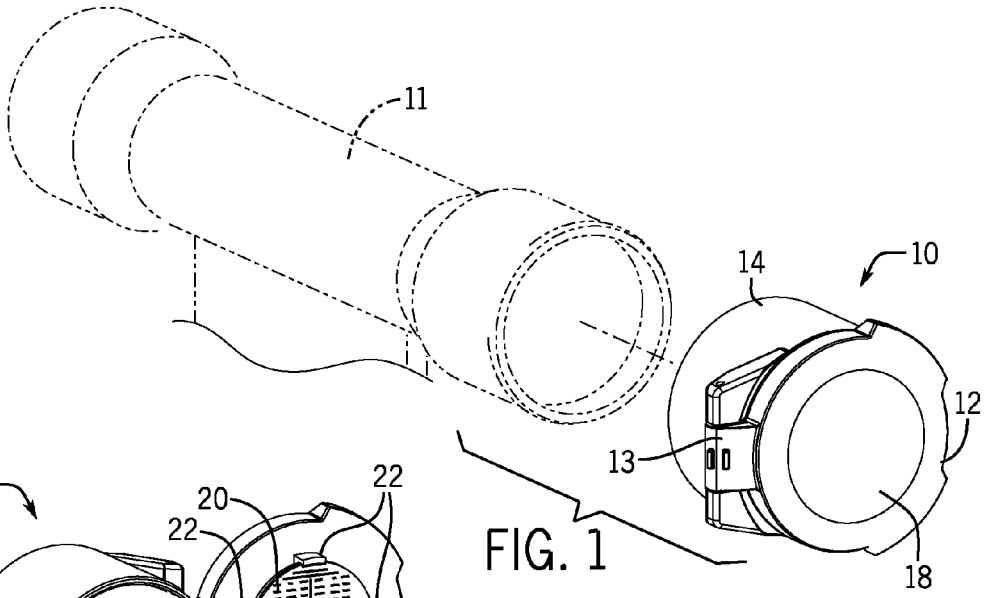
FIG. 1 is an isometric view showing the attachment of an optic cover to a sighting device.
Figure 2:
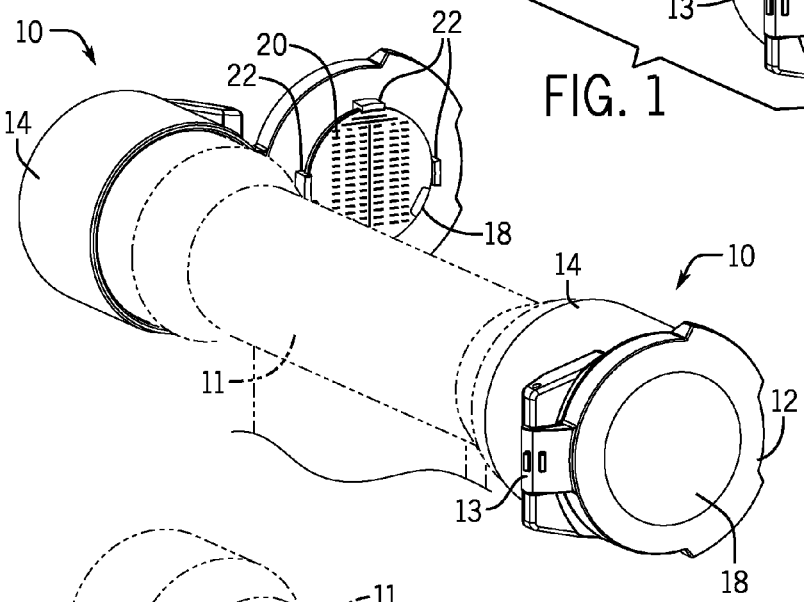
FIG. 2 is an isometric view of a closed optic cover attached to one end of a sighting device and an open optic cover attached to another end of the sighting device.
Figure 3:
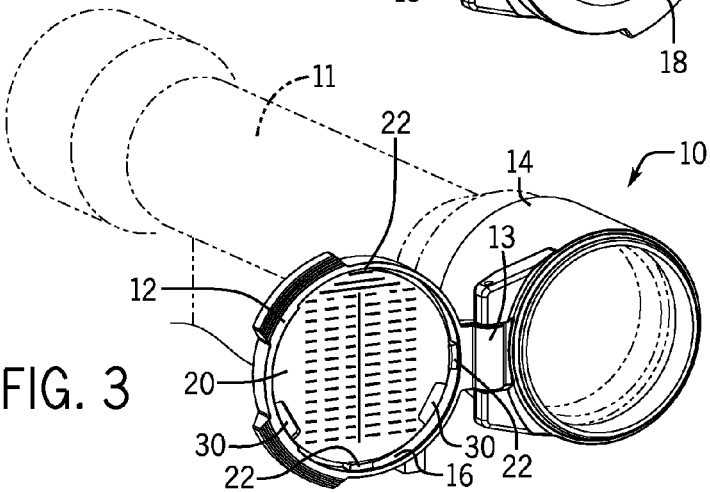
FIG. 3 is an isometric view of an optic cover with the cap open and retaining a display.

Referring now to FIG. 1, one aspect of the present invention provides a flip cap style cover 10 for an optic device 11 such as a scope or other sighting device. As seen in FIG. 2, a cover 10 can be used on each end of the optic device 11. The cover 10 includes a cap 12 attached to the cover, such as, for example, by a hinge 13 such that the cover can be opened and closed as seen in FIGS. 2 and 3. Other constructions for attaching a cap 12 to a cover 10 are known in the industry, the use of which would not defeat the spirit of the invention. The cover 10 can also include a body 14 for attaching the cover to an optic device 11.

Another embodiment of the invention is a cap 12 as will be described, for attaching to an existing cover body 14 so as to retrofit the cap 12 or cover 10 to any aftermarket optic cover or optic device available.

Figure 4:
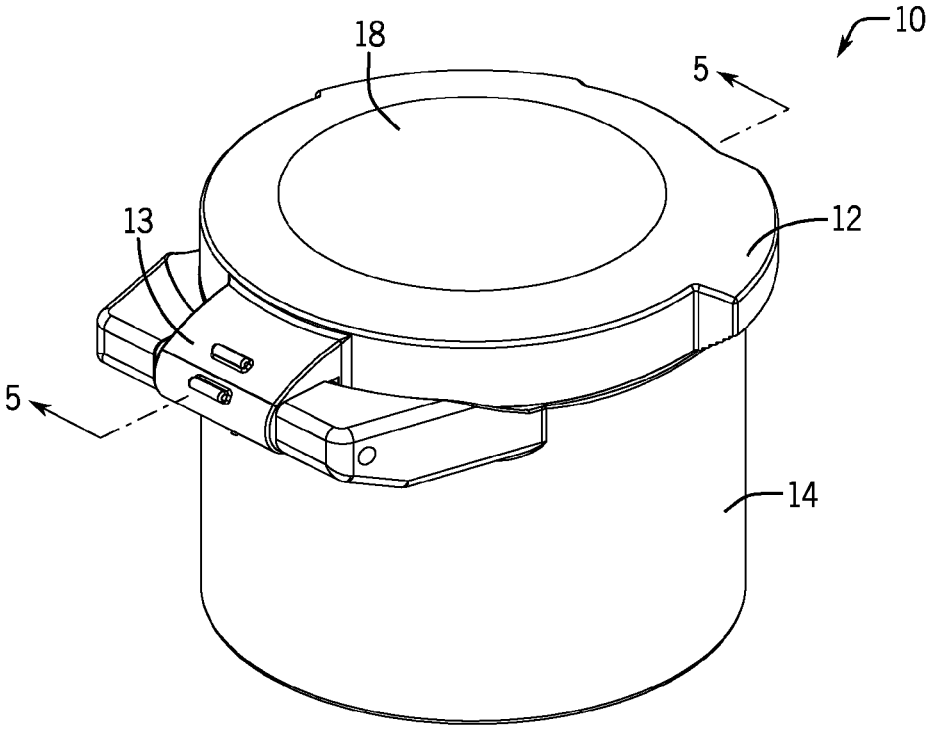
FIG. 4 is an enlarged isometric view of a closed optic cover.
Figure 5:
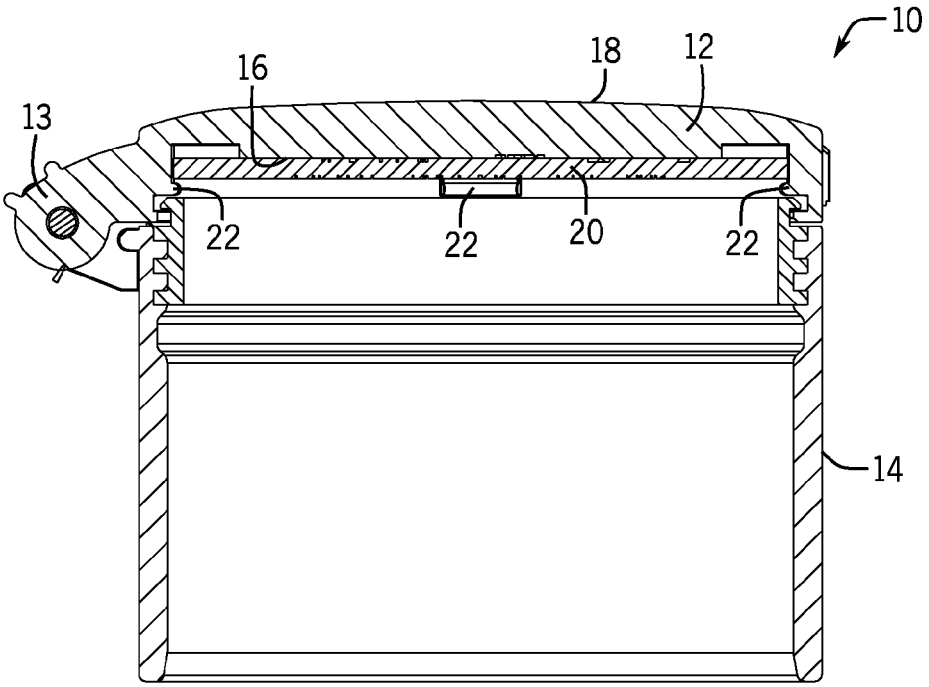
FIG. 5 is a cross-section view of the optic cover of FIG. 4 along the line 5-5.

The cap 12 has an interior portion 16, seen in FIG. 3, and an exterior portion 18, seen in FIG. 4. When the cap 12 is in the closed configuration, such as, when the optic device 11 is not being used, the exterior portion 18 of the cap 12 is exposed to the environment and the interior portion 16 of the cap faces the optic device 11 as seen in FIG. 5.

When the cap 12 is in the open configuration as seen in FIG. 3, such as, when a shooter desires to use the optic device 11, the interior portion 16 of the cap 12 faces the shooter. When using two covers 10, such as shown in FIG. 2, the exterior portion 18 of the cap 12 of the second cover will also face the shooter when open. If the cap of each cover is set up to open in a different direction, both the interior portion 16 of the first cap and the exterior portion 18 of the second cap will be visible to the shooter.

Figure 6:
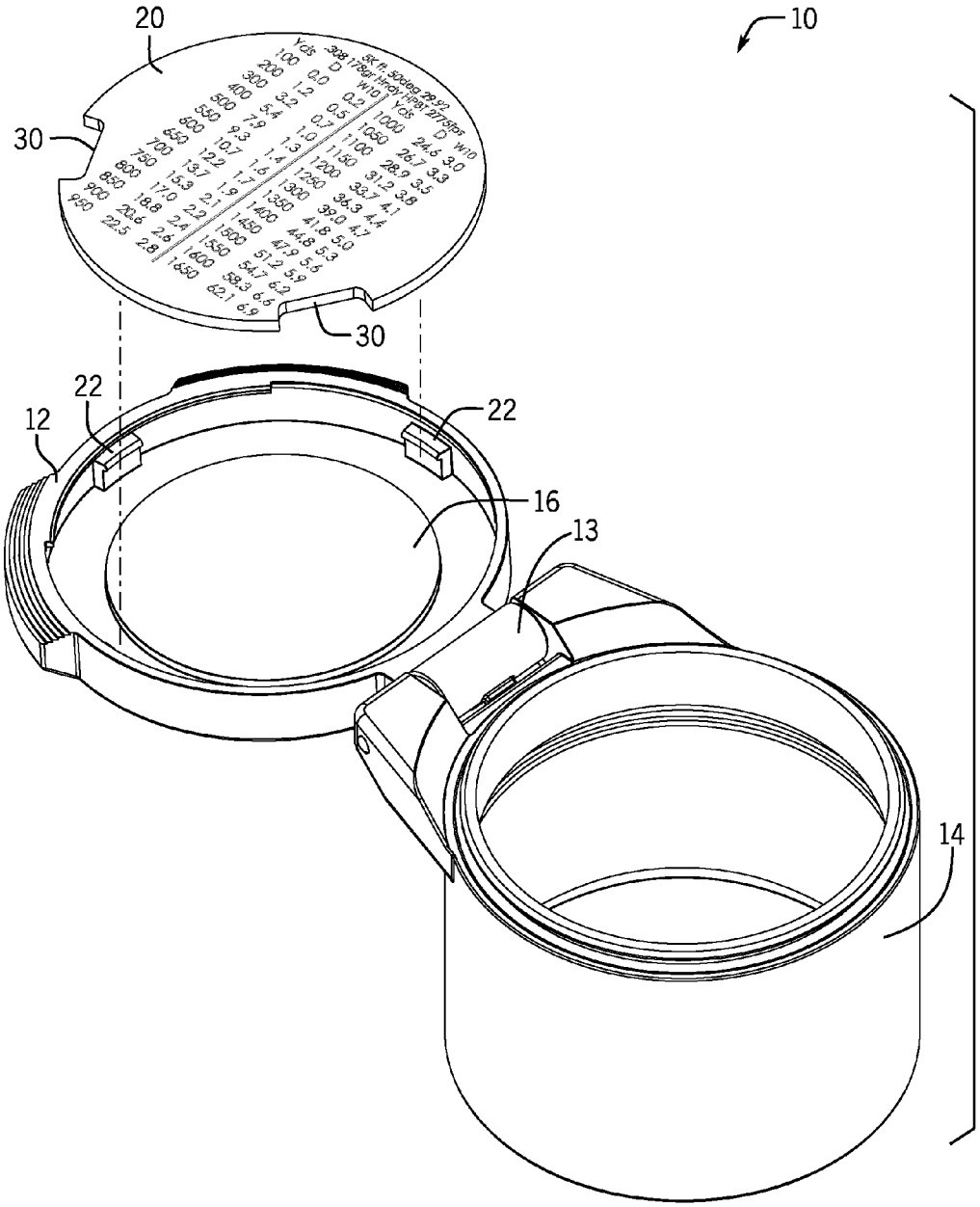
FIG. 6 is an isometric view of an optic cover with the cap open and the display removed.

As shown in FIG. 3, the interior portion 16 of the cap 12 is capable of holding a display 20 which can show information such as DOPE. In one embodiment, the display 20 is round in shape and held by the interior portion 16 of the cap 12 by tabs 22 permanently attached thereto, such as by integrally forming the cap and tabs, which resiliently hold the display 20 in place. (See FIG. 6). For example, the tabs 22 can be made of a resilient plastic that will temporarily deform when sufficient force is applied. To further encourage deformation upon application of pressure, the tops of the tabs 22 could also be angled. Thus, when the display 20 is pushed on the tabs 22, such as by a shooter, the tabs deform to receive the display and allow the display to slide past the deformed tabs and to be seated. Once the display 20 is seated, the tabs 22 retake their original shape and thereby securely hold and firmly retain the display 20 in place. This embodiment provides a balance between ease of removal of the display 20 and securement of display while shooting.

Although the embodiment described above discloses that the interior portion 16 of the cap 12 releasably retains a display 20, the exterior portion 18 of the cap or both the interior portion and the exterior portion could be capable of retaining displays. For example, when a cover 10 is used on each end of an optic device 11, it may be desirable to have the cap 12 from the first cover releasably retain a display 20 on the interior portion 16 and the cap 12 from the second cover releasably retain a display 20 on the exterior portion 18 such that two displays are visible to the shooter when using the optic device.

Figure 7:
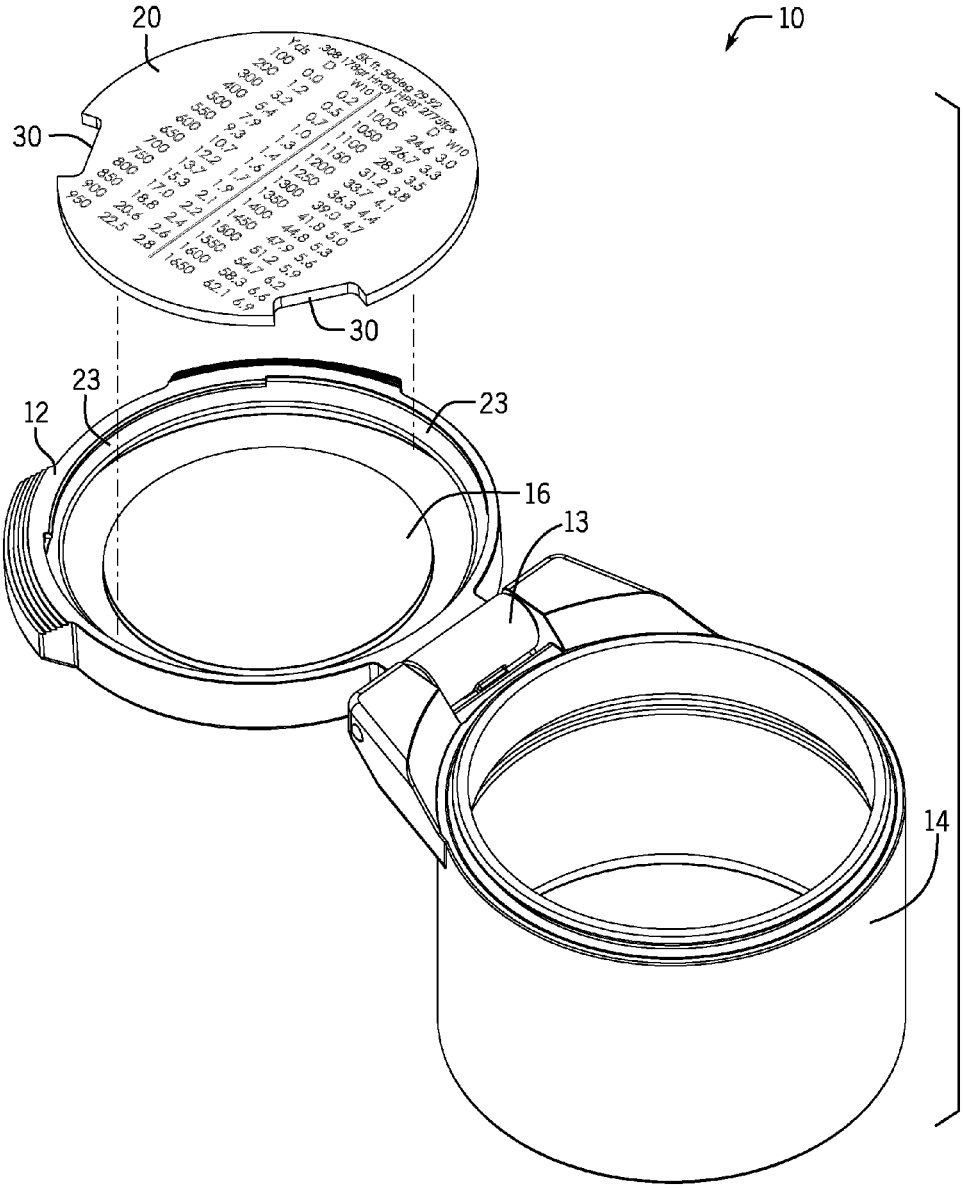
FIG. 7 is an isometric view of an alternative embodiment of an optic cover with the cap open and the display removed.

In another embodiment, the display 20 is held by a resilient annular ridge, ring or flange of the cap 12. As seen in FIG. 7, the annular flange 23 extends along the perimeter of the interior portion 16 of the cap 12. Although the annular flange 23 is shown as a continuous flange, the flange could also be intermittent along the interior portion 16. Similar to the tabs 22 above, the annual flange 23 can be made of a resilient material such that the annular flange will deform when the display 20 is being seated and thereafter retake its original shape to hold the display in place.

Figure 8:
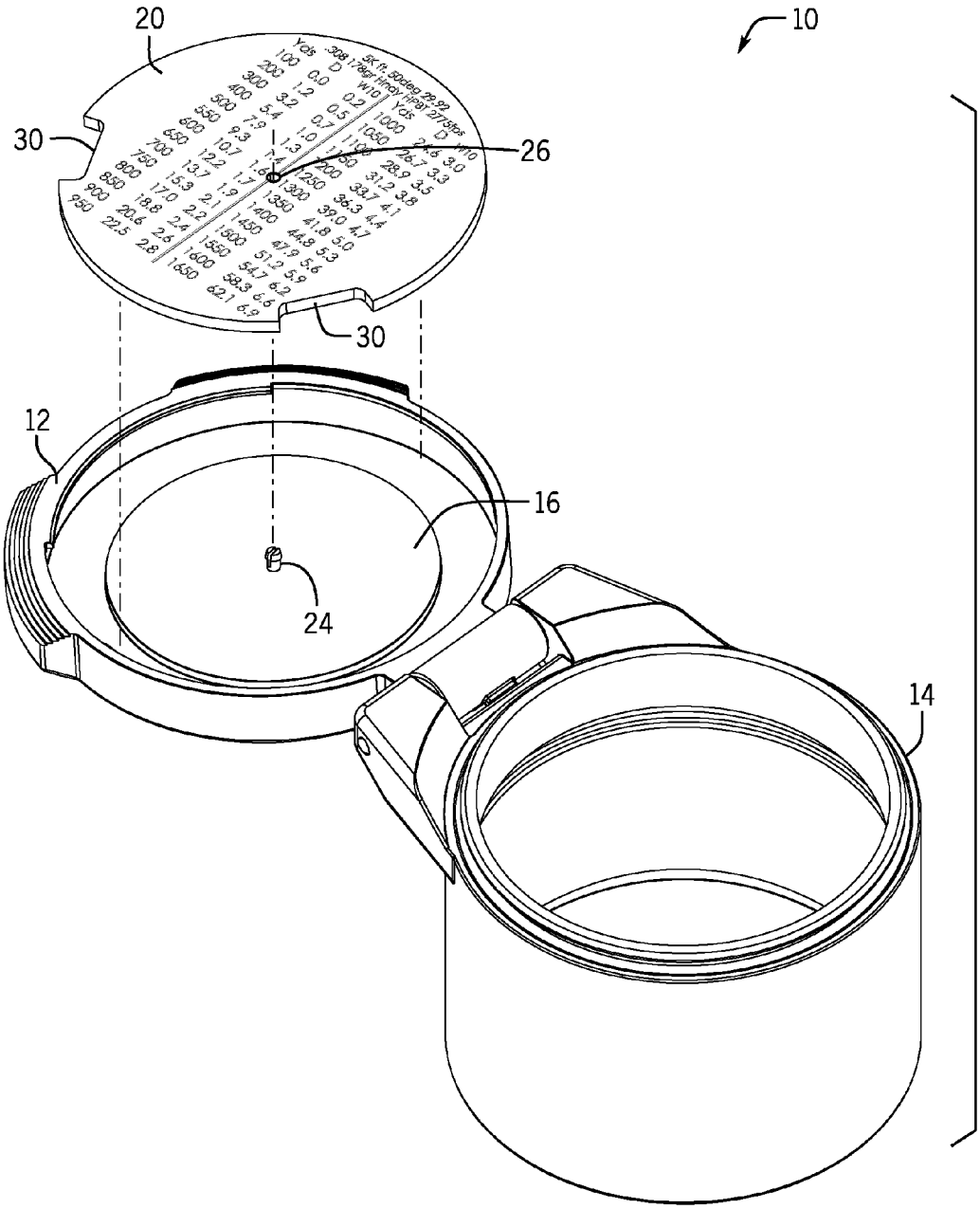
FIG. 8 is an isometric view of another alternative embodiment of an optic cover with the cap open and the display removed.

In another embodiment, the display is held by at least one post 24 of the cap 12. The one or more post(s) 24 could be made from a resilient material and located at the center of the interior portion 16 of the cap 12 as seen in FIG. 8, or located around the circumference of the interior portion 16 of the cap 12 similar to the tabs 22. In the embodiment shown in FIG. 8, the post 24 is slotted and has a top portion with a diameter bigger than the corresponding hole 26 in the display 20. When the display 20 is placed onto the post 24, such that the hole 26 is above the post, and downward pressure is applied, the slot allows the top portion of the post to compress and thereby fit through the hole. After the display 20 is past the top portion, the top portion of the post 24 returns to its original size to thereby hold the display in place. When the display 20 is removed, the upward force applied to the post 24 by the display, causes the top portion of the post to compress to fit back through the hole 26 such that the display is removed.

Figure 9:
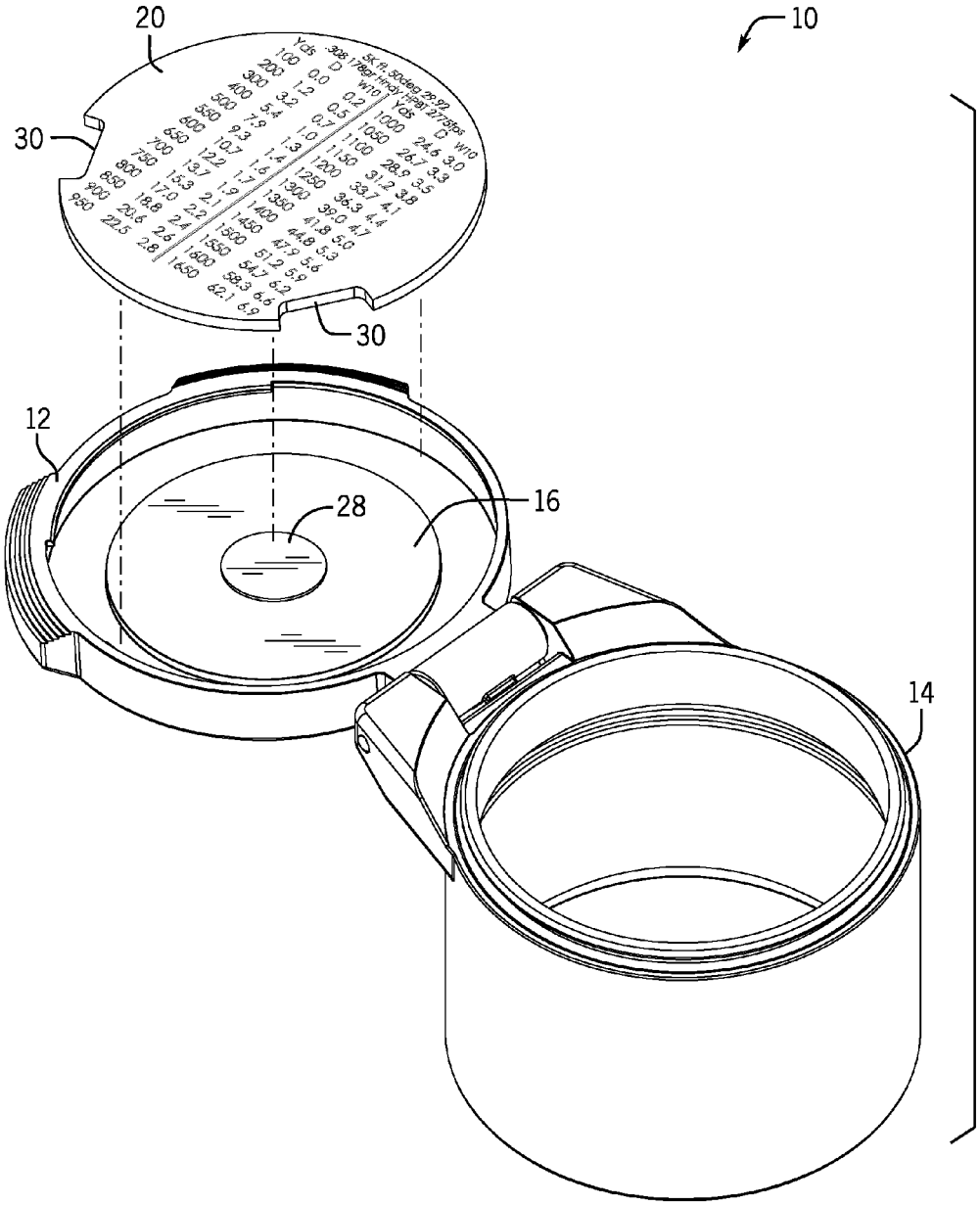
FIG. 9 is an isometric view of another alternative embodiment of an optic cover with the cap open and the display removed.

In yet another embodiment, the display is held by a magnet 28, or magnets, permanently attached to the cap 12 as seen in FIG. 9. The display 20 could be made from a material that is attracted to the magnet(s) 28 or have such a material attached to it.

The retention configurations described above allow the display 20 to be rotated up to 360 degrees while being held by the cap 12. Although such rotation is not necessary, it allows the information shown on the display 20 to be right side up and readable regardless of the shooter's preferred orientation for the cap 12, for example, above the optic device 11 or to the side such as shown in FIG. 3. The resilient retention member configurations described above are also economical to manufacture.

The display 20 includes a means for removing the display from the cap 12. In the embodiment shown in FIG. 10, the display 20 has a number of indents 30 formed in the perimeter of the display. The indents 30 are sized and positioned in the display 20 such that the indents allow the shooter to selectively remove the display from the tabs 22 of the cap 12. In the embodiment shown in FIG. 6, the indents 30 allow the display 20 to be removed by use of a fingernail or the bullet, such as the tip or rim of the casing. Although the embodiment shown in FIG. 6 allows the display 20 to be removed without the use of tools, configurations requiring the use of a tool to release and remove the display 20 from the cap 12 would not defeat the spirit of the invention.

Figure 10:
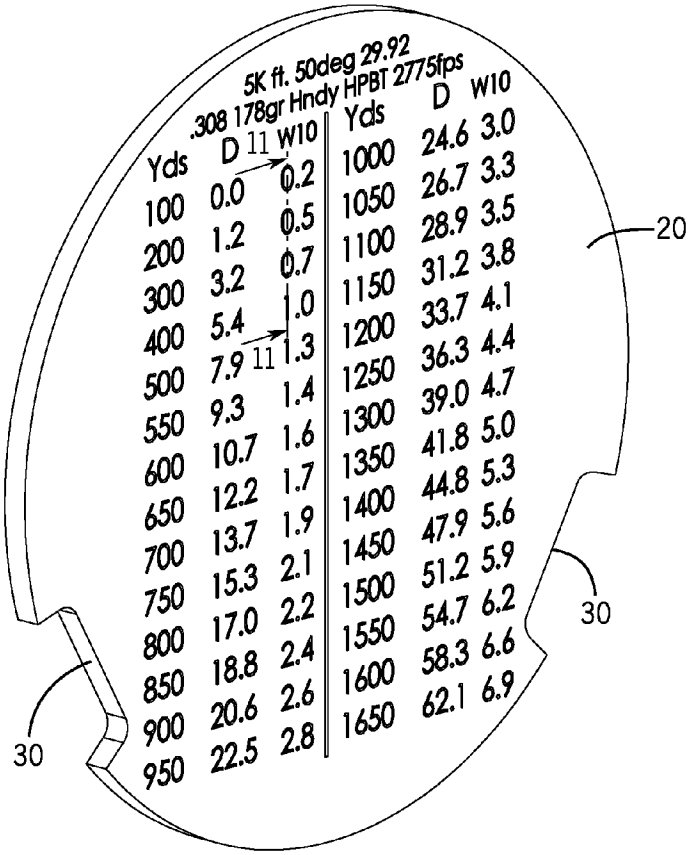
FIG. 10 is an isometric view of one embodiment of a display in accordance with the invention.

The display 20 may be made of a material that is resistant to environmental conditions such as water, ultraviolet light, heat, cold, etc., as may be experienced while shooting. For example, the display 20 when exposed to moisture, ultraviolet light and/or temperatures in the range from about −20° F. to 120° F. does not substantially deform in its shape or substantially change color so as to affect the performance of the display. The display 20 can also have information permanently affixed thereto or therein as seen in FIG. 10 or have permanent spaces for a shooter to fill in such information or DOPE.

Figure 11:
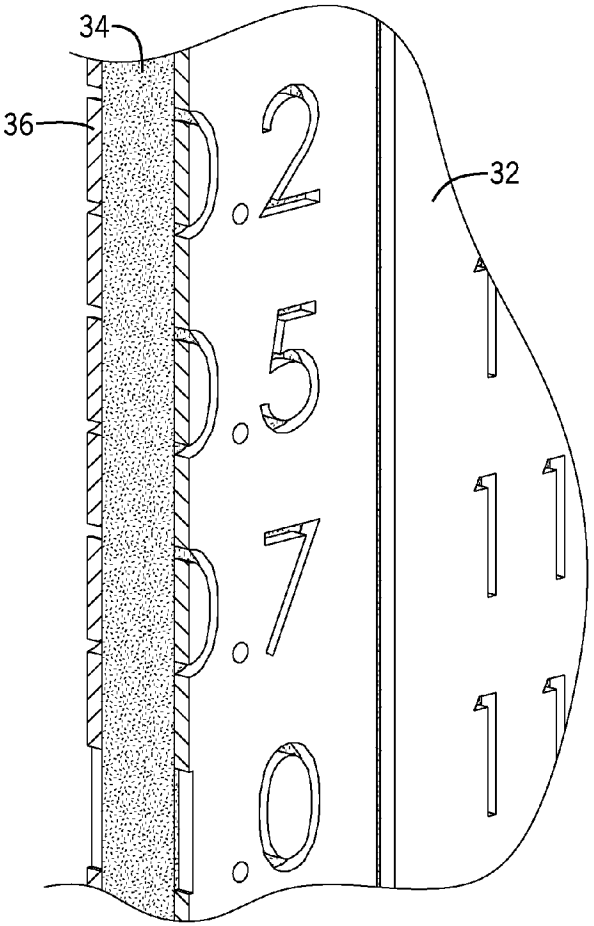
FIG. 11 is an isometric view of a cross section of the display of FIG. 10 taken along the line 11-11.

In one embodiment, the display 20 can be made or formed from layers of plastic coupled or fixed together. As seen in FIG. 11, the display 20 is made from coupling or fixing a top substrate 32 to one side of a middle substrate 34 and coupling or fixing a bottom substrate 36 to another side of the middle substrate. The top and bottom substrates 32, 36 can be thinner than the middle substrate 34 and of a color different than the middle substrate. The top and bottom layers or substrates 32, 36 can be laser engraved so as to remove portions of the top and bottom layers thereby exposing the middle layer or substrate 34 of a different color. Such engravings can also be used to cut the display 20 to the desired size and shape from a larger sheet or sheets of material. Using three layers allows both sides of the display 20 to contain information such as DOPE.

One example of such a display 20 entails using bright yellow outer layers and a black middle layer. The contrast of the yellow and black allows the information, such as shooting information, to be easily conveyed or seen at night as would the use of photo-chromatic material. Other applications or user preferences could suggest different color combinations.

Other numbers of layers can also be used without departing from the invention. For example, a two layered display could be made with just the top layer 32 and the middle layer 34, in which case the middle layer 34 would also be the bottom layer. Further, the display 20 could be made from one substrate such as, for example, if the display is made from a material that is attracted to the magnet 28 as seen in FIG. 9.

Other methods of adding information such as DOPE to a display 20 include, but are not limited to printing on the display, attaching stickers to the display with information printed on the stickers or allowing such information to be written on the stickers by a shooter or allowing a shooter to write directly on the substrate. The use of such methods would not defeat the spirit of the invention.

It is anticipated that a shooter could be carrying multiple displays 20 with different types of information during an activity, for example long range target practice. The shooter could quickly and easily change to a display 20 with the appropriate information for the firearm, bullet and/or environmental conditions being faced at that time.

A system for configuring a DOPE chart 90 may include a user computer 100 and a server 102. In one embodiment, user computer 100 and server 102 are connected to each other via the internet. Although the embodiments shown in the drawings suggest that the user computer 100 and the server 102 are separate, in other embodiments, the functions of the user computer and server may be combined into a single computer. Furthermore, the functions shown as occurring on a single server 102 may alternatively be performed by a plurality of servers, with each server performing some or all of the functions of server 102.

Figure 12:
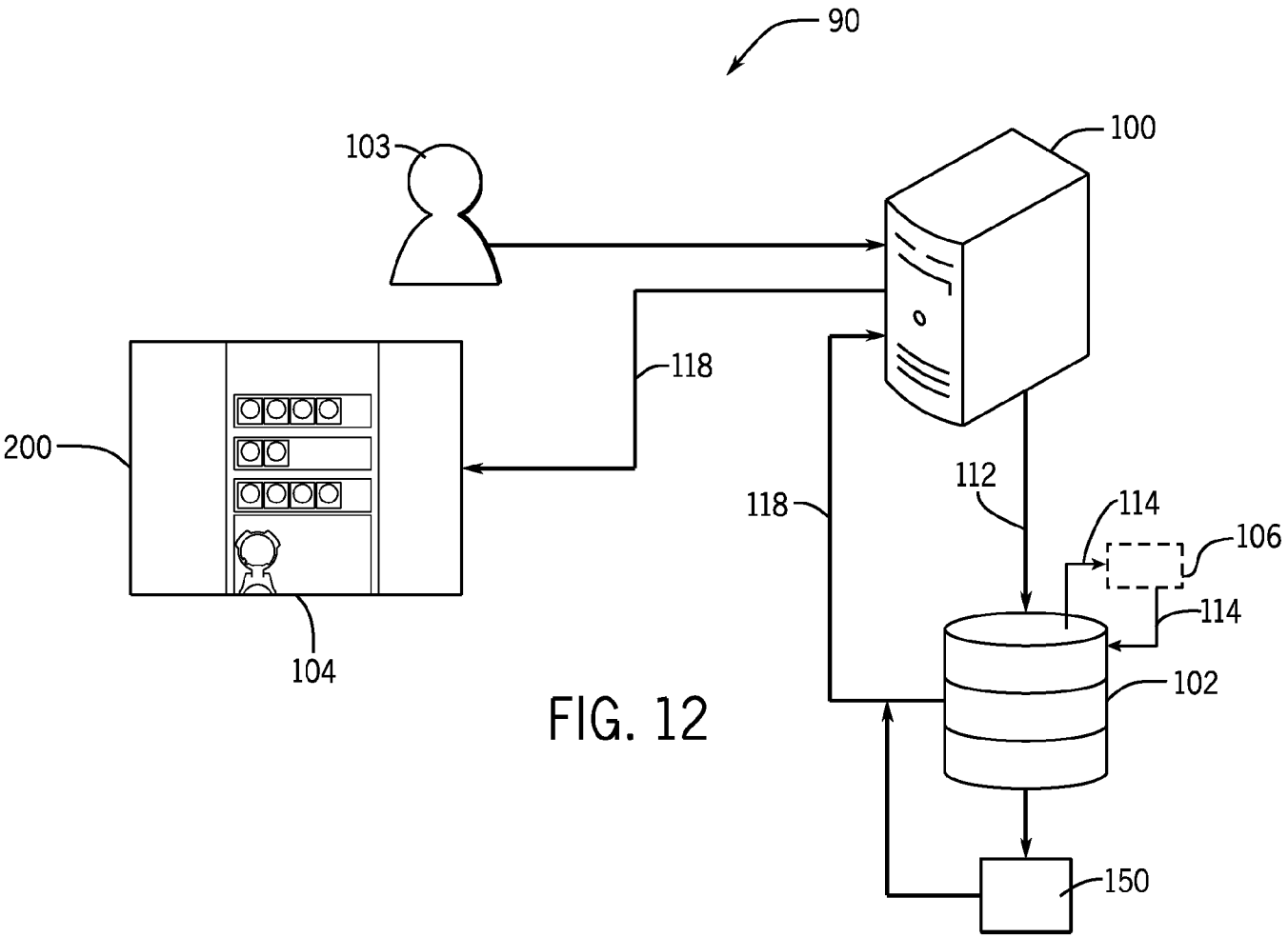
FIG. 12 is a schematic of a system for configuring a DOPE chart in accordance with the invention showing how a user connects to the system.

FIG. 12 shows one embodiment of system architecture that may be used to configure a DOPE chart according to the systems 90 described herein. A user 103 begins the configuration process by submitting an initial request 112 from the user computer 100 to server 102. In one embodiment, the initial request 112 is made by logging onto a website 104. In some embodiments, the initial request 112 may also cause the server 102 to query 114 a database 106 to determine whether user 103 has a previously saved user profile 150 on the system. If the database 106 includes a user profile 150, the database answers the user profile query 116 by providing user profile data to server 102, which incorporates the data when it answers 118 the initial request 112. User interactions with the system 90 are primarily through the use of a configuration interface 200, which may be a computer based graphical user interface displayed on a screen on a computing device. As shown in the figures, configuration interface 200 may be a web-based display, which may be accessed on a computer screen but could also be a digital interface accessed through a smartphone, tablet, or any other computing device.

User profile 150 is particularly useful for a user 103 who has multiple gun/ammunition combinations, which could be stored in the user profile that the user could access at any time. User profile 150 could include a multitude of information including not only user's 103 gun/ammunition combinations, but locational and/or environmental data as well. For example, as discussed above, a shooter could carry multiple displays 20 with different types of information during an activity, such as an annual hunting trip. User profile 150 provides a virtual storage location for DOPE information, including, for example multiple DOPE charts 250 or DOPE values for multiple displays 20. Furthermore, the system could allow user 103 to create highly tailored DOPE charts 250 that include not only locational information such as elevation, but could also include current or forecast weather information or any other information user 103 would find useful. Such weather information could be pulled from any of the available internet weather databases. For the shooter who takes an annual hunting trip, his or her user profile 150 could include a particular gun/ammunition combination he or she likes to use on the trip. A couple of days before, or even the day of the hunt, the shooter could either manually input weather data for the location, or use data gathered from the internet to create a display 20 for that year's hunt. The shooter could also include location, date, or weather information in a "title" section of the border 202, or any other location made available to the shooter.

Figure 13:
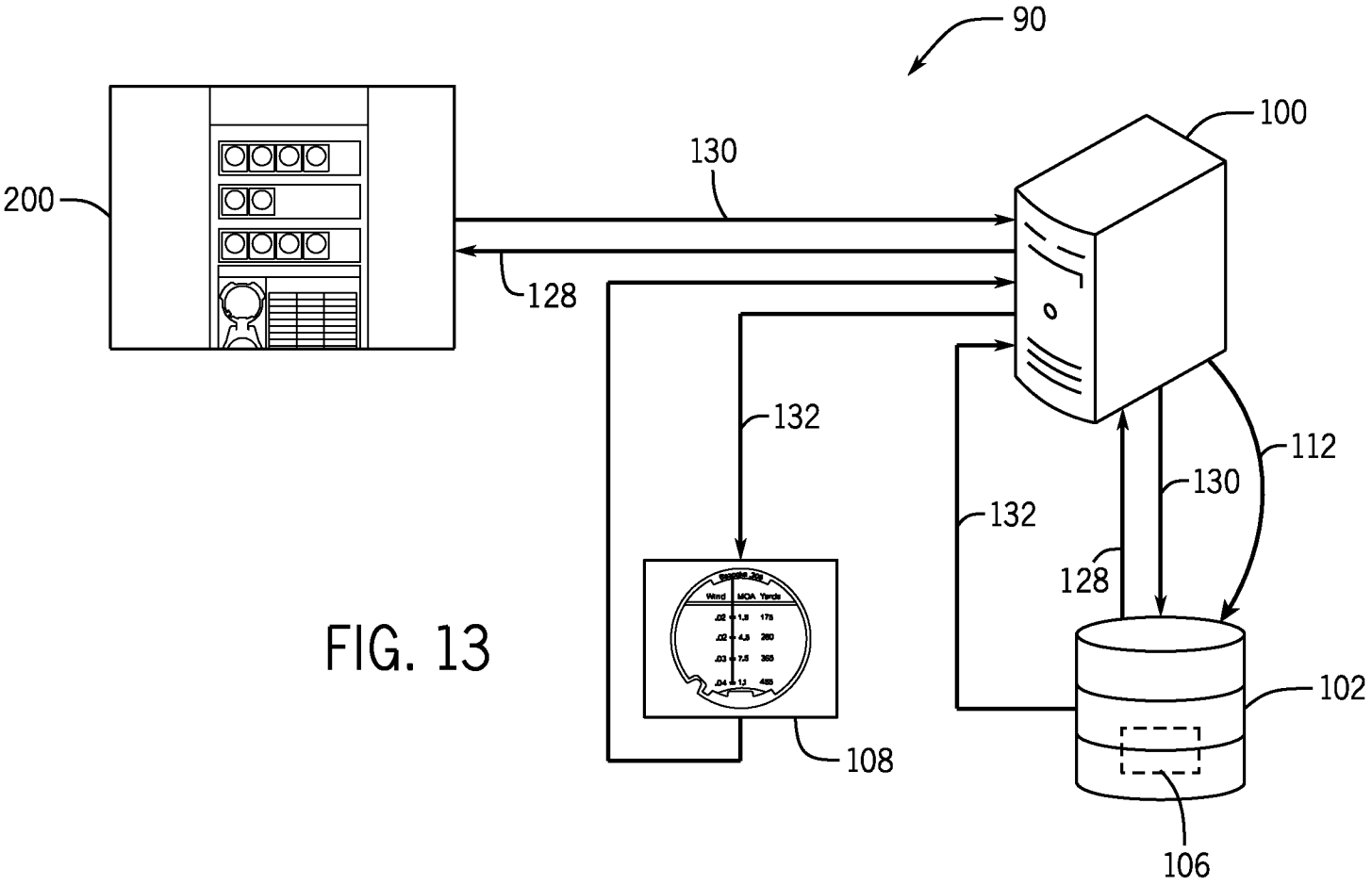
FIG. 13 is a schematic of the system for configuring a DOPE chart, showing how data is managed between a configuration interface and a server.

FIG. 13 shows how data may be managed between a configuration interface 200 and server 102. As shown, server 102 sends website data back 128 to user computer 100 upon receiving the initial request 112. After the website 104 is displayed to user 103, he or she may choose from a plurality of options to create their desired display 20 configuration. Although user 103 logs onto website 104 in the embodiment shown, in alternative embodiments, user 103 may configure a display 20 using a program stored locally on user computer 100. As user 103 interacts with the system 90, data is sent 130 from the user computer 100 to server 102 where it is processed. Server 102 then generates 132 an image 108 based on the user's 103 selections. In the embodiment shown, this data transfer happens in real time so user 103 can instantly view the current configuration via real-tine preview 218 (as shown in FIGS. 20-24).

The following Coffeescript, which is compiled into Javascript, is a simplified example of how the real-time preview 218 may be updated in accordance with the invention. Although Coffeescript is used herein, any suitable programming language may also be used without departing from the invention.

```
module.exports = (ImageBorder = (context, settings) ->
  switch settings.borderType
    when 'thick'
      context.lineWidth = 200
    when 'thin'
      context.lineWidth = 100
  context.beginPath( )
  context.arc width/2, height/2, width/2 - context.lineWidth / 2, 0,
Math.PI*2
  context.stroke( )
```

The script shown above is pseudo code of one of a plurality of layers of checks performed by the system to determine whether user 103 has updated any of the parameters of the customized DOPE chart 250. As an example, the script above determines the line width for a DOPE chart border. The script writes to an "ImageBorder" file that is an image of the border section of a DOPE chart. In the script above, line width may be either 200 pixels or 100 pixels depending on the user's selection of a "thick" or "thin" line. After user 103 selects a desired width, the script writes a path of an arc having the selected thickness and stores it as the ImageBorder file.

Figure 20:
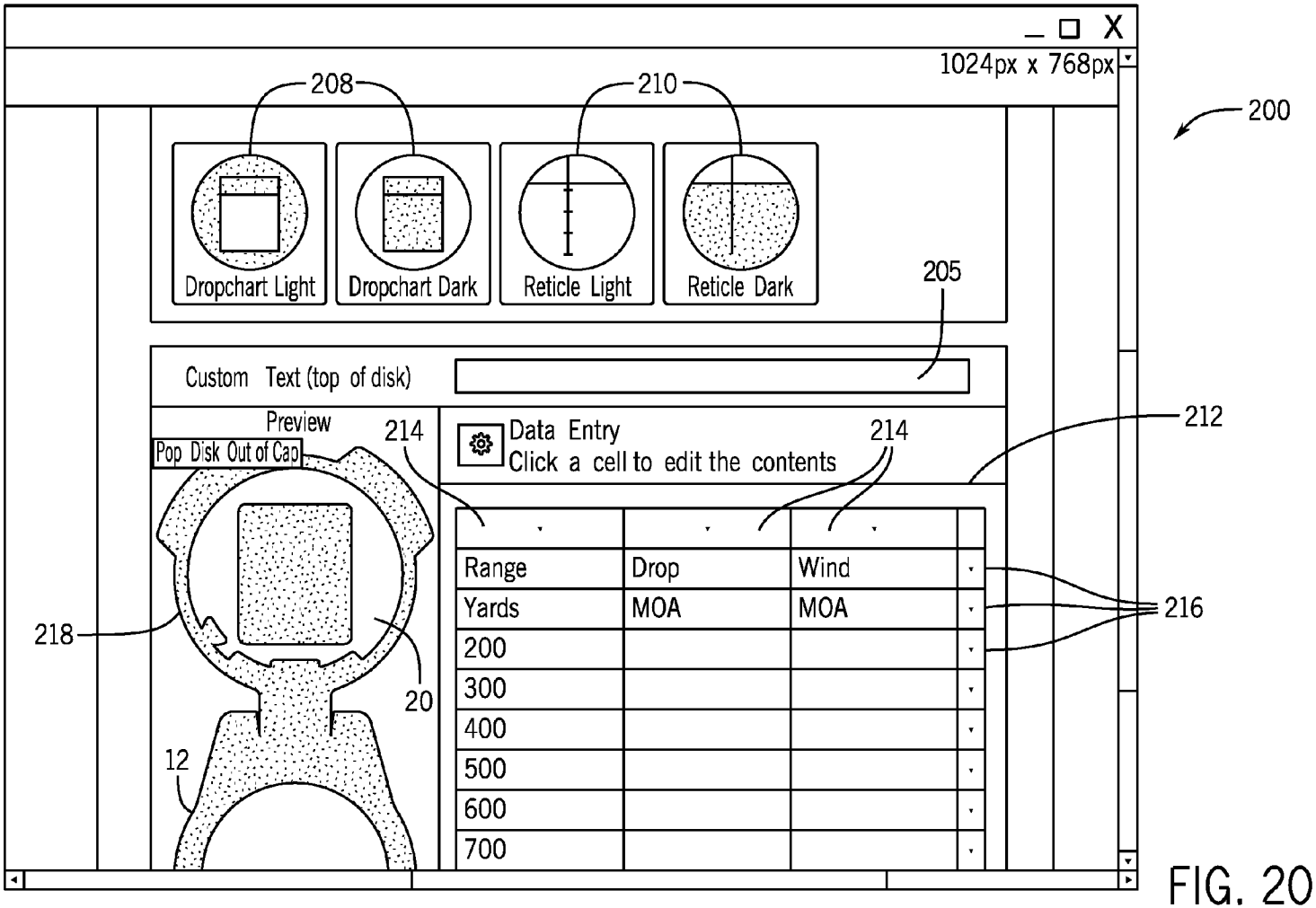
FIG. 20 is a schematic of the configurator interface of FIG. 16 showing the selection of a DOPE chart style.

Several scripts similar to the one above may be run sequentially, one for each parameter presented to the user 103, and one for a data entry chart 212 (as shown, e.g., in FIG. 20). The system then compiles the image files generated by each section of script into one file, which is real-time preview 218. If any of the parameters has a changed value, the system generates a new real-time preview 218 file that is displayed to user 103. One way the system may run its check is to run a debounce code that monitors multiple keys, debounces them, and detects key hold and release. Using a debounce code will allow the system to only run the update script when user 103 has not pressed a key for a period of time, or if the user presses a particular key or set of keys. Only running the update script if a period of time passes between presses of a key frees up system resources, which allows the system to use less internet bandwidth and less memory on the server 102 and on the user computer 100. For example, the debounce code may look for a time X during which no buttons are pressed. Then, if no button is pressed during time X, the debounce code initiates the update script. Of course, other methods may also be used to initiate the update script without departing from the invention, but a debounce code is one exemplary way of efficiently determining when to initiate the update script.

Following is one example of a pseudo debounce code in accordance with the invention but other debounce codes may alternatively be used. Two scripts are included below, the first script on the user side, and the second script on the server side. As with the script above, the scripts below are written in Coffeescript, which compiles in to Javascript, but any suitable programming language may also be used without departing from the invention.

```
columns = 3
rows = 10
data = Array( colums * rows )
React.createClass
  render: ->
    <table>
      {for c in [0...columns]
```

-continued

```
            <tr>
            {for r in [0...rows]
              <td>
                <input onChange={@onChange c, r} />
              </td>
            }
            </tr>
          }
        </table>
      componentDidMount: ->
          @updateImage = __.debounce @updateImage, 2000
        onChange: (c, r) ->
        return (event) =>
          data[c * rows + r] = $(event.target).val( )
          @updateImage( )
        updateImage: ->
          $.post '/save__data', {data: data}, (response) =>
          $('.preview-image').attr('src', '/path/to/image-' +
          (new Date).getTime( ) +
    '.png')
```

The script shown above is pseudo code that renders the real-time preview 218, monitors for user typing, and sends information to the server. The script as shown first renders a table or "Array" having three columns and ten rows. Next, the debounce code runs, which looks for image updates two seconds (2000 milliseconds) after the last keystroke. After two seconds have elapsed, and if a change has been made, the system saves the table data to the server 102 and updates the real-time preview 218 that includes a timestamp so the system knows when it receives a new image.

The next script is shown below and may be on the server side, where the server 102 accepts information from the user computer 100, and saves the data. The server may receive a request for an image, which it will render and serve back to the user computer as real-time preview 218.

```
app = require('express')( )
app.post '/save__data', (req, res, next) =>
  database.find(id: req.session.id).set(req.body.data).save( )
  res.json({success: true, message: 'successfully updated data'})
imageLayers = require('./imageLayers')
app.get '/path/to/image-:timestamp.png', (req, res, next) =>
  settings = database.find(id: req.session.id)
  canvas = new Canvas(2100, 2100)
  context = canvas.getContext('2d')
  __.each imageLayers, (layer) =>
    layer(context, settings)
  res.sendCanvas(canvas)
```

Figure 14:
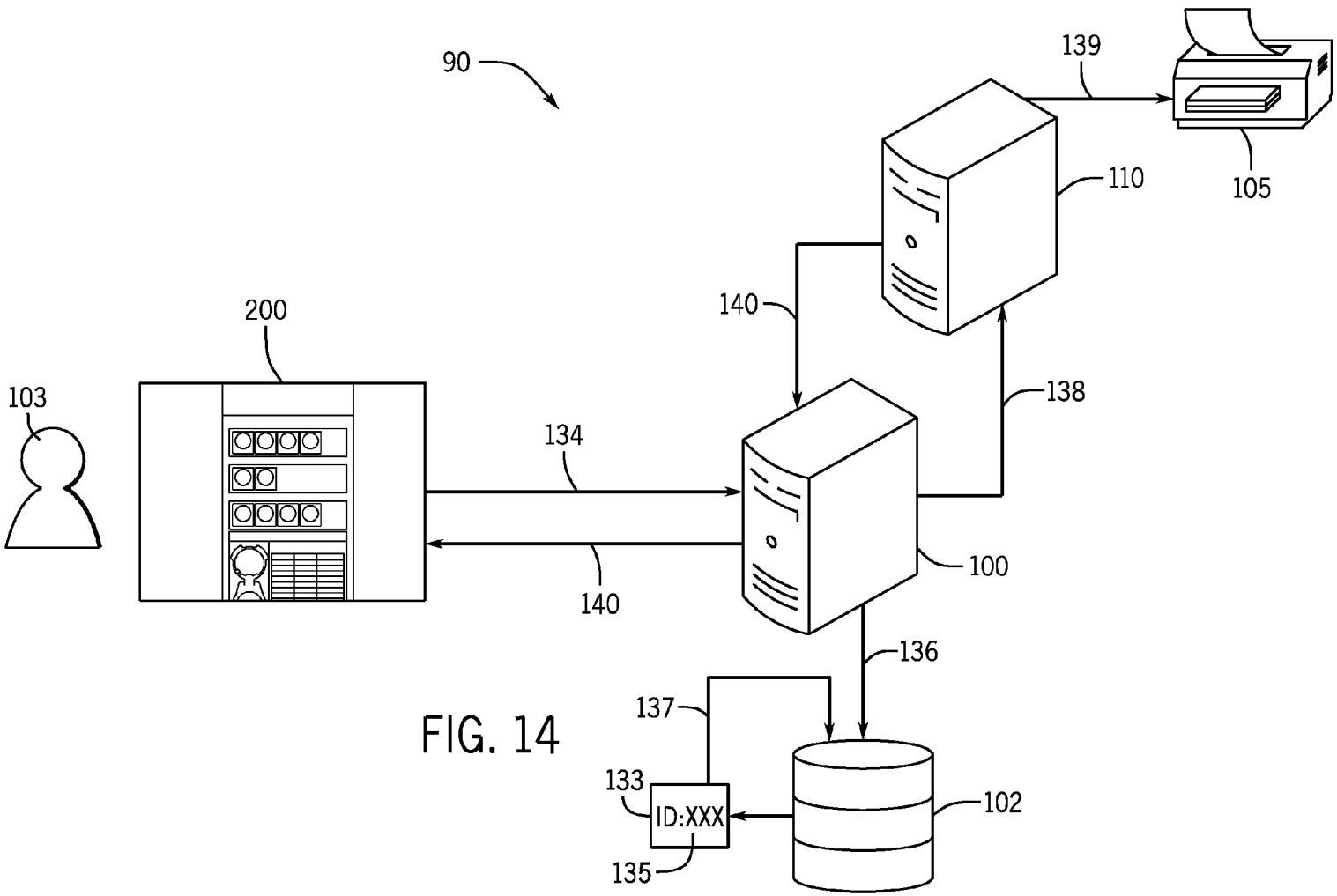
FIG. 14 is a schematic of the system for configuring a DOPE chart, showing how the system may interact with a printer or engraver to produce a DOPE chart.

FIG. 14 shows how the system 90 may communicate with or include a printer or an engraver, which may be used to produce a display 20. As shown in FIG. 14, a user 103 may purchase a display 20 when user has finished configuring the display 20 using a configuration interface 200 displayed on user computer 100. In the embodiment shown, to start the purchasing process, user 103 initiates a purchase request 134. When the purchase request 134 is initiated, the display 20 configuration data is copied to a production file 133. One way of keeping track of production files 133 is through the use of a unique IDs 135. For example, when the production file 133 is transferred 136 to server 102, a unique ID 135 may be generated that is associated with the production file. The production file 133 (as identified by unique ID 135) is saved 137 in the user's 103 cart, which is stored on server 102. When the system has multiple production files 133, they may be managed, stored, identified and recalled using unique IDs 135. When user 103 is ready to purchase a display 20, he or she pays for the display using a typical e-commerce system. Once user 103 has paid for the display 20, a request 138 is sent to a production server 110 that causes 139 printer 105 to print or engrave the image 108 of the display 20 onto a blank disc, and confirmation of the purchase is sent 140 back to the configuration interface 200. In one embodiment, a laser engraver, such as but not limited to an Epilog Mini, may be used to remove a layer of material from the blank disk to reveal a complimentary color. Of course, any other suitable printer or engraver may be used without departing from the invention. Finally, the now completed display 20 is ready to be delivered to user 103. Such delivery may be accomplished by any suitable means, including but not limited to mailing or picking up in a store.

Figure 15:
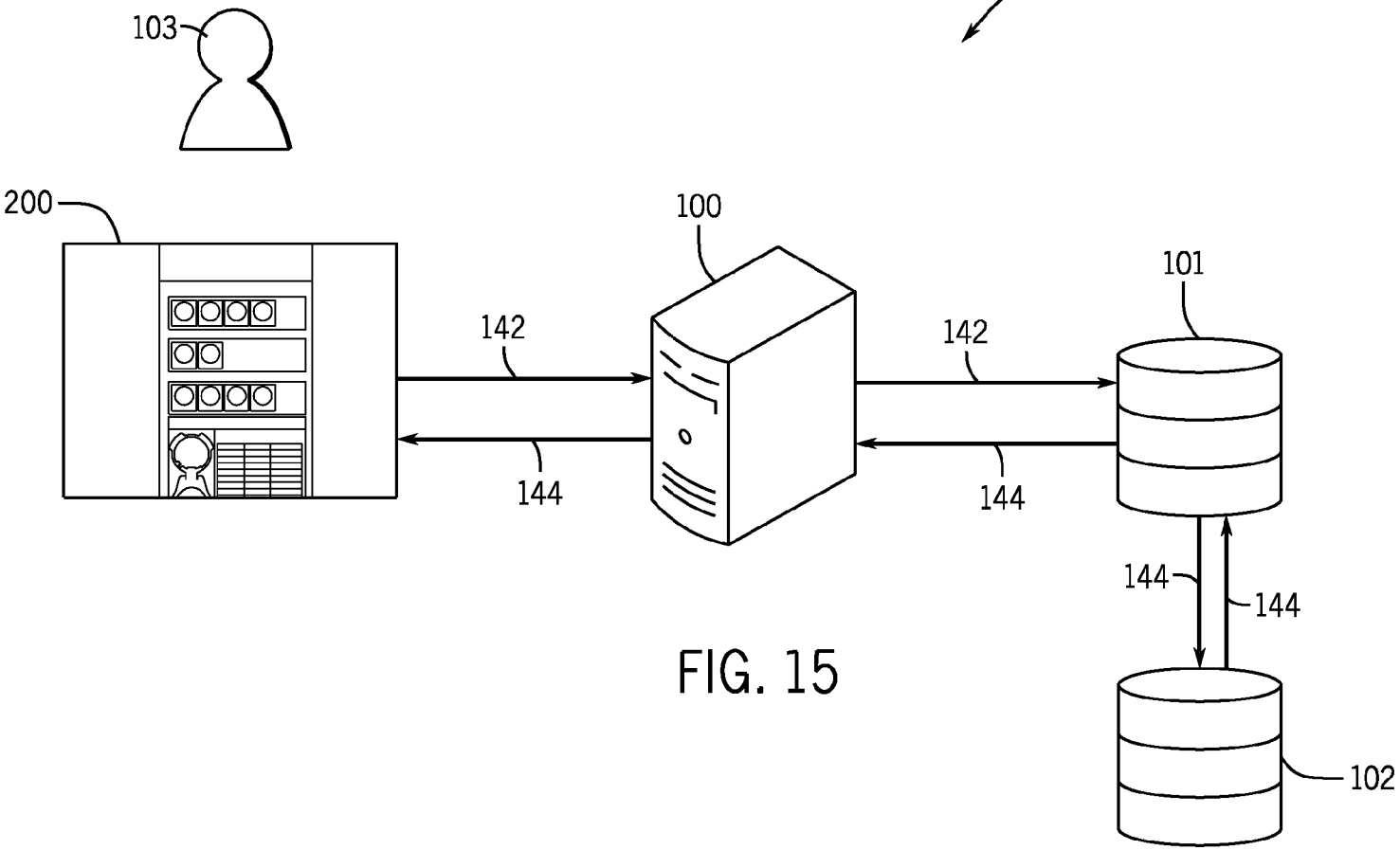
FIG. 15 is a schematic of the system for configuring a custom DOPE chart, showing how data from a ballistics calculator may be used to create a DOPE chart.

FIG. 15 shows how data from a ballistics calculator may be used to create a DOPE chart 250. As shown, the system 90 may also include accessing a ballistic calculator server 101. In such an embodiment, user 103 may access information stored on the ballistic calculator server 101 by submitting a request 142 through the configuration interface 200. Such a request 142 may include a variety of variables including but not limited to gun model, ammunition type, weather data, elevation data or any other type of relevant information. Ballistic calculators are known in the art and quickly and easily provide shooters with bullet flight path information that traditionally would take a great deal of manual calculations. To use a typical ballistic calculator, user 103 selects the gun, ammunition, and other environmental factors into a form. The calculator then generates DOPE data that can be used to create a DOPE chart 250. After accessing 144 the information from the ballistic calculator server 101, the system 90 fills in relevant portions of the configuration screen 200. Using such a ballistic calculator saves the shooter a great deal of time and produces error free DOPE charts 250.

Figure 16:
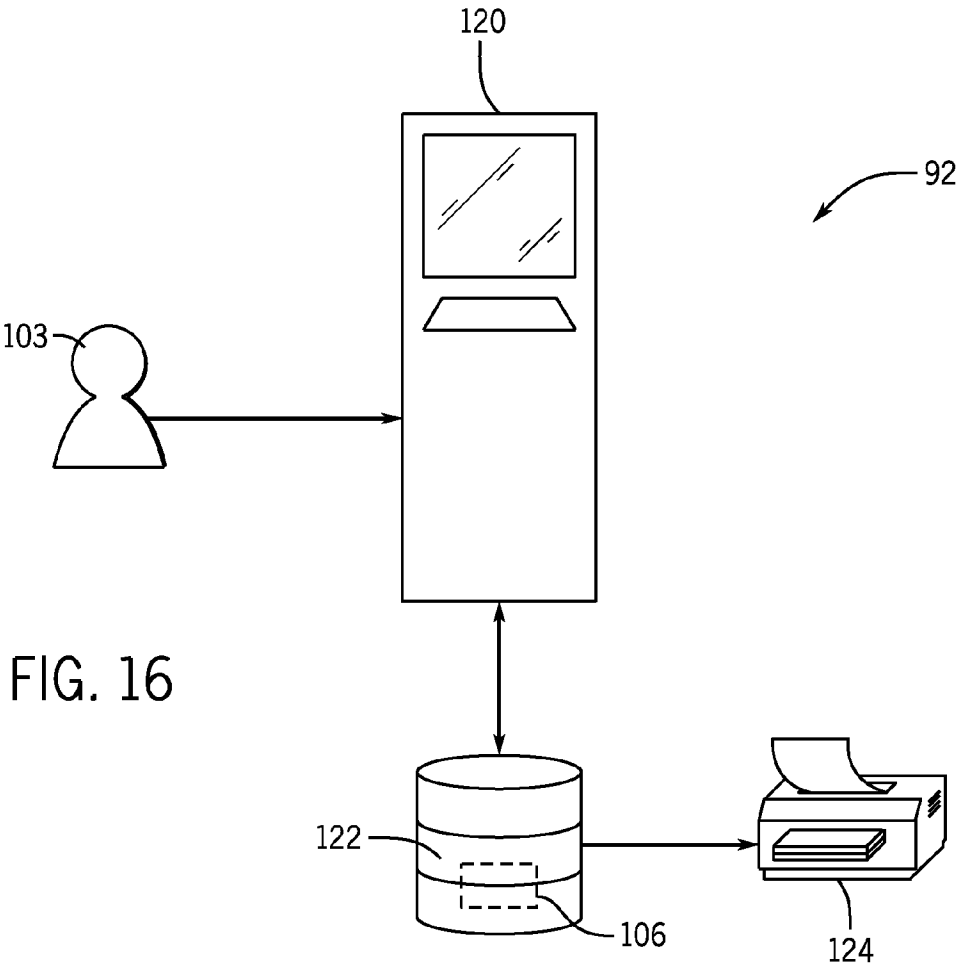
FIG. 16 is a schematic of one embodiment of a system for configuring a custom DOPE chart in accordance with the present invention that includes a kiosk and a local server.

FIG. 16 shows an alternative embodiment of a system for creating a DOPE chart that comprises a completely local system 92 that is not connected to the internet. For example, a point of sale kiosk 120 could be provided in a store that could provide most of the functions of the system. Of course, such a "local" embodiment may include at least one locally networked server 122 to store database 106 and perform some of the other functions of the system as well. For example, a plurality of sales kiosks 120 could be provided at one or more store locations, all of which are connected to one or more local servers 122 that provide all of the data necessary to operate the system, not unlike a typical server/workstation arrangement in a local area network. Furthermore, one or more local printers 124 may also be provided as part of the point of sale kiosk 120, or provided elsewhere in the store, which would produce the displays 20 while user 103 waits. As noted previously, printer 124 may also be an engraver or any other suitable type of production or reproduction device.

Figure 17:
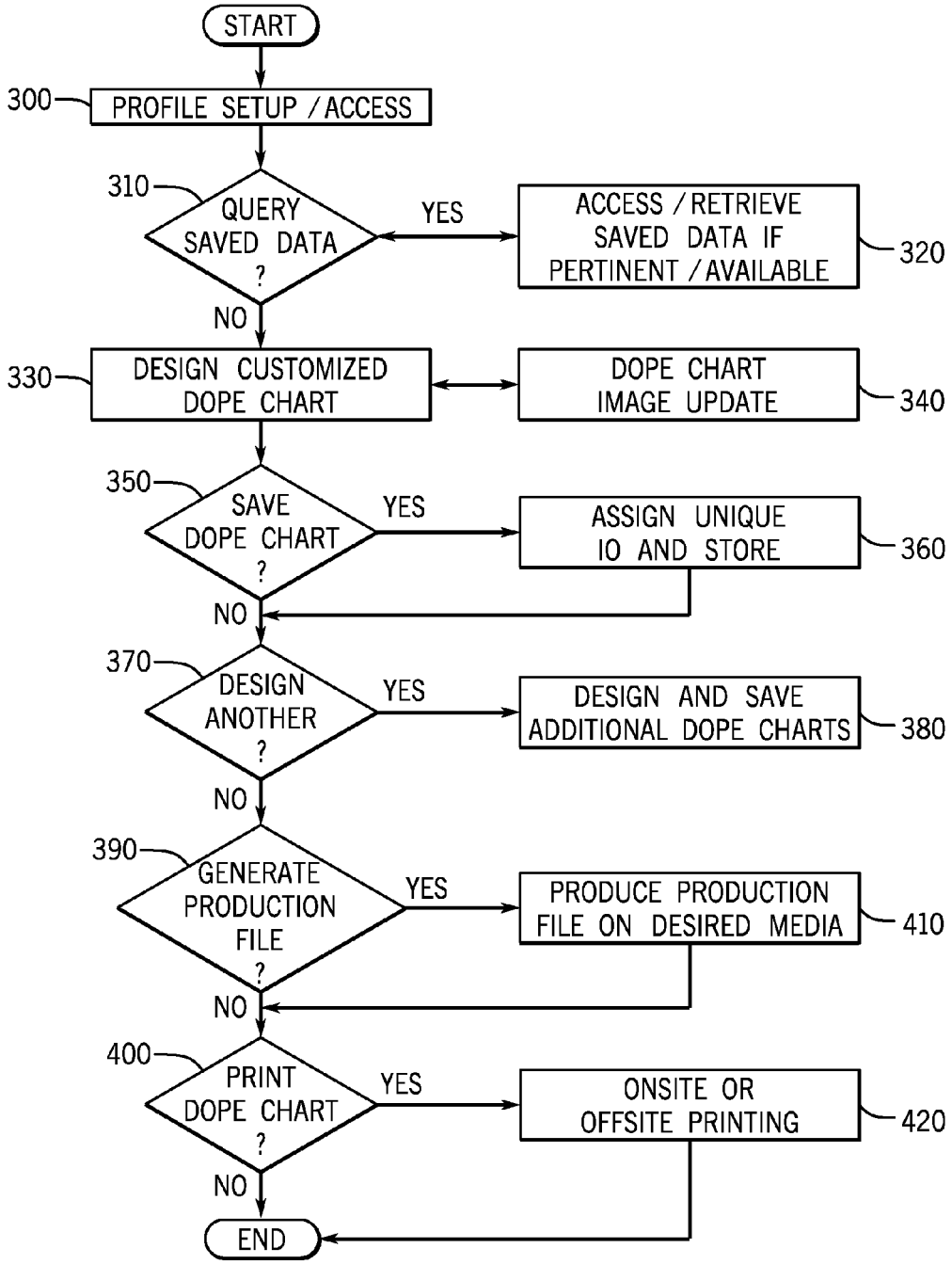
FIG. 17 is a flow chart illustrating a method of configuring and producing a DOPE chart for use with an optic device in accordance with the present invention.

FIG. 17 illustrates one method of configuring and producing one or more DOPE charts 250 for use on a display 20 or otherwise in connection with an optic device 11. At step 300, the user of the system conducts certain profile set-up activities, and the system interacts with system components such as user computer 100 and server 102, which receive and provide information for the profile set-up activities. Profile set-up activities may include, for example, logging in to the system, providing username and/or password credentials, or other identifying information. Step 300 may also include creating a user profile 150, navigating to the appropriate configuration interface, or other preliminary data entry, security clearance, or navigation activities before engaging in further steps in the process.

At step 310, server 102 may query from database 106 any saved data that may be pertinent or available for use in the method. For example, saved data may be data saved from prior uses of the system, or may be data files from other sources, such as ballistic calculators or user generated data files stored outside of the system. If relevant saved data exists, the server may access and retrieve such data at step 320. In one embodiment, the query at step 310 would allow a user to import data files or access data files from outside systems into database 106. In other embodiments, the query at step 310 simply allows the user to specify instructions to retrieve data files already stored in database 106. Although step 310 is depicted in FIG. 17 in an early step of the disclosed method, in other embodiments, the system may query saved data at any point in the process, or at multiple points in the process, including during step 330, which is discussed in more detail below.

At step 330, configuration interface 200 is provided for use in allowing a system user to provide and receive instructions to server 102 and database 106 to allow user to design a customized DOPE chart, which is further illustrated and described in FIGS. 18-24 and related descriptions. Configuration interface 200 may provide an image 108 and/or real-time preview 218 showing a depiction of the customized DOPE chart 250 and display 20, which image is updated to reflect changes or instructions provided into the configuration interface 200 at step 340. The real-time preview 218 may be a 3D rendering showing an image of a display 20. User 103 can manipulate the real-time preview 218 in real time, which allows the user to rotate, zoom in or out, and open or close the cap 12. The real-time preview 218 may be a 3D rendering in the three.js file format, but any other suitable file format may be used without departing from the invention. Image 108 may comprise the customized DOPE chart 250, which is mapped onto the real-time preview 218. In an alternative embodiment, the real-time preview 218 could be omitted, with only a final image 108 shown to user 103. Omitting the real-time preview 218 may be advantageous in situations where there is limited internet bandwidth or limited graphics performance on a device used to access the configuration interface 200 such as if a user were to access the configuration interface 200 from a mobile device.

After the customized DOPE chart 250 is prepared through configuration interface 200, at step 350, server 102 provides user 103 the option to save the DOPE chart 250 as configured. If user 103 instructs the system to save the chart, server 102 assigns a unique identifier to the chart and stores or saves the chart at step 360. Prepared DOPE charts 250 may be stored in the system at database 106, or may be stored or saved externally in other databases, memory, or storage media.

At step 370, server 102 provides user 103 an option to design another DOPE chart 250, or multiple charts. If user 103 instructs the system to run the steps to design any additional charts, step 380 depicts the system operation that provides for designing and saving additional charts, for example by repeating steps 310 through 370, as described above.

At step 390, server 102 may provide user 103 an option to generate a production file containing the DOPE chart 250 for use in printed DOPE charts, for exporting, or for other purposes. A production file may be of any suitable file format, for example, a .png image. If user instructs the system to generate a production file, at step 410, the system may provide instructions for generating the production file in the desired file format or on the desired media or through the desired channels, such as via email, file download, or file transfer protocol (FTP).

At step 400, server 102 may provide user 103 an option to print one or more DOPE charts 250. DOPE charts 250 may be printed on a variety of materials for a variety of purposes. For example, DOPE chart 250 may be printed or engraved on a substrate for use as a removable display 20 in an optic cover or flip cap. Alternatively, DOPE charts 250 may be printed on paper, or other substrates for reference materials, or flip books. Although the terms "print," "printer," or "printing" are used herein, it should be understood that the print option step 400, printer 105, and the like may include other known production and reproduction methods and devices, such as engraving using a laser engraver, etching and other marking techniques. Printing may occur in the same location as user computer 100, or may occur at offsite locations, as noted in step 420 in FIG. 17. Several different configurations are possible within the spirit of the invention. For example, a user may use the configuration interface 200 at their home and then go to a retail location for printing of the DOPE charts onto substrates or displays 20. Alternatively, user may use the configuration interface 200 at home and then place orders for displays 20 via internet, email, or phone, and such displays 20 may be shipped to user 103 at a specified location. As another example, the system may be located entirely at a retail location, such as a retailer of sport optics and other sporting goods, such that sportsmen may customize DOPE charts at the retail location, purchase, and have them printed onto displays all at a single retail location as an additional service provided by such retailer. DOPE charts 250 and displays 20 may also be viewed or shown digitally such as on a smartphone, tablet, smart watch, or other wearable or digital device.

It should be noted that the steps illustrated in FIG. 17 are exemplary and illustrative only; there may be more or less steps in the method, ands steps may be performed in an order different than described here.

Figure 18:
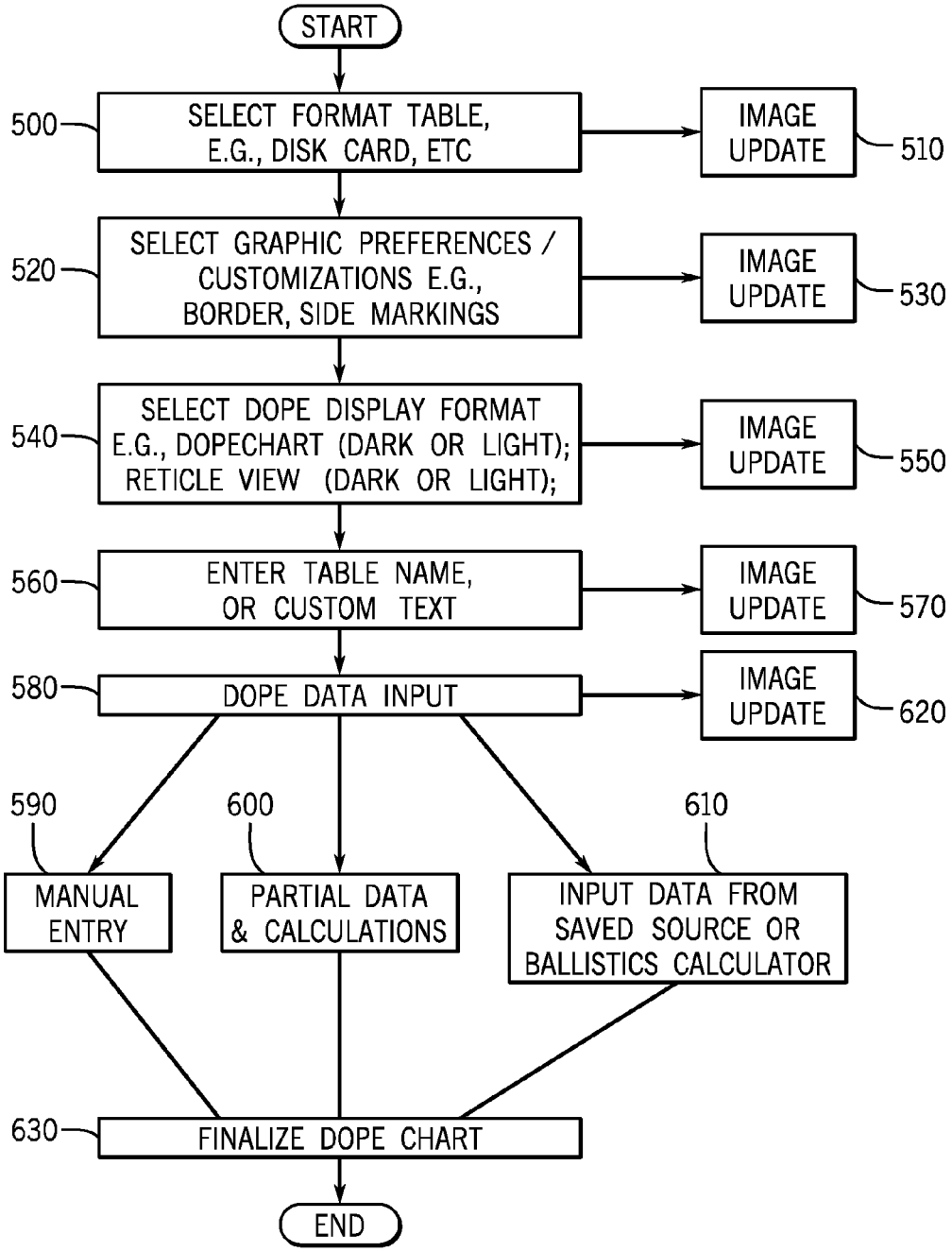
FIG. 18 is a flow chart illustrating a method of designing a customized DOPE chart in accordance with the present invention.

FIG. 18 illustrates one method of designing a customized DOPE chart 250; the steps identified in FIG. 18 may all be performed as sub-steps of step 330 as shown in FIG. 17. In one embodiment, user 103 provides instructions to server 102 through configuration interface 200, which is shown in exemplary drawings in FIGS. 19-24.

In step 500, user 103 selects the format of the DOPE chart 250, including selection of options or preferences for chart format, such as a disk, table, card, or other display format. Although several of the Figures show displays 20 as substantially circular inserts, DOPE charts 250 and displays 20 do not need to be limited to such shapes, and may be provided in a square, rectangular, octagonal, or any other suitable shape. One embodiment of a configuration interface 200 showing selections options for this step is shown in FIG. 20. Once user selects format choices in step 500, server 102, at step 510, updates the image 108 and/or real-time preview 218 to reflect the current selections.

Figure 19:
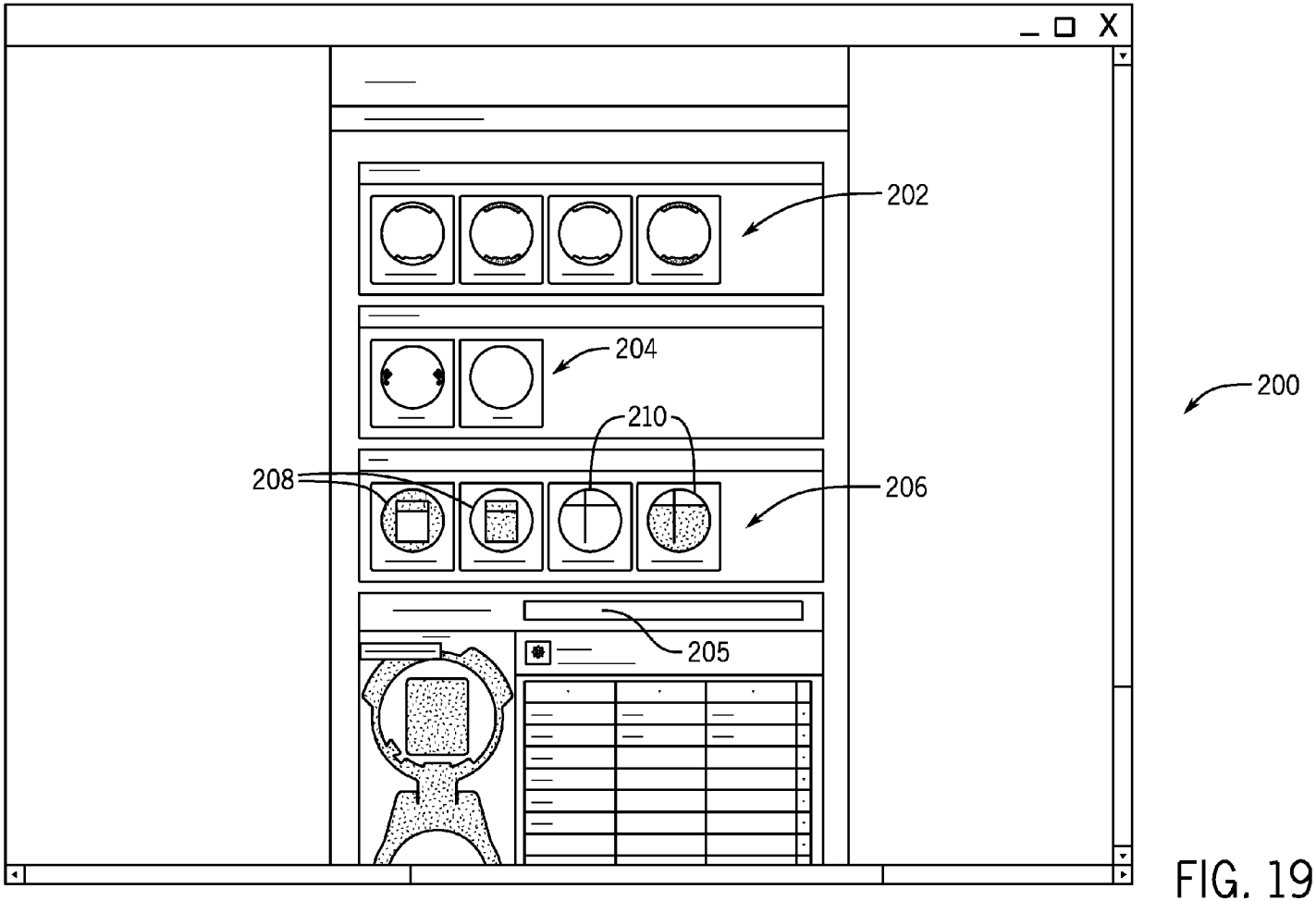
FIG. 19 is a schematic of a configurator interface in accordance with the invention.

In step 520, user 103 selects graphic preference and customizations for the DOPE chart 250, such as selection of borders, shadings, side markings, or logo markings. It may be possible to provide both textual and ornamental options. One embodiment of a configuration interface 200 showing options for graphic selections is shown in FIG. 19, specifically, showing options for selecting border 202, and other graphics 204. Once user 103 selects graphic preferences in this step 520, server 102, at step 530, causes the image 108 and/or real-time preview 218 to reflect the user's 103 current selections.

In step 540, user 103 may select the DOPE display format. For example, display options may include a dropchart format (in either light or dark colors), or a reticle view format (in either light or dark colors). A variety of other display options may be included as well within the spirit of the invention. One embodiment of a configuration interface 200 showing these options is shown in FIGS. 19 and 20. For example, FIGS. 19 and 20 show options for selecting a drop chart style DOPE chart 208 (with light or dark background) or a reticle style chart 210 (with light or dark background). Once user 103 selects the DOPE display format, server 102, at step 550, causes the image 108 and/or real-time preview 218 to reflect the user's 103 current selections.

At step 560, user 103 may enter naming information to describe or name the DOPE chart 250 being created, and/or enter custom text to be associated with the DOPE chart 250. This is also shown in FIG. 20, which shows the display of such naming information or custom text at 205. Server 102, at step 570, similarly updates image 108 and/or real-time preview 218 to reflect current text or naming entered.

At step 580, user 103 enters, imports, or causes DOPE data to be populated on the DOPE chart 250. As shown in FIG. 20, this data may include minutes of angle (MOA), range, bullet drop, and wind data, but may include other combinations of DOPE data as well. Several methods may be used to provide DOPE data in step 580, including simple manual entry 590 of data, partial data entry and partial program calculations 600 performed by instructions on the server 102, or by importing data from outside the program 610, such as from a file saved outside of the system, or from a ballistic calculator that is integral with the system or external to it. Server 102, at step 620, updates image 108 and/or real-time preview 218 to reflect such data entry, import, or population so user 103 can see what the DOPE chart may look like when finished.

At step 630, user 103 is offered a choice to finalize the DOPE chart 250 or to make further edits. As will be readily apparent to one of ordinary skill in the art, the steps shown in FIG. 18 need not be performed in this order; this is simply one example of the steps for designing a customized DOPE chart 250. More or less steps may be provided, and in different order. Additionally, different parameters, choices, or options may be provided. Some non-limiting examples of other options may be the ability to choose the placement of the DOPE chart on the disk and allowing user 103 to add photos or other graphics.

FIGS. 19-24 show multiple screen views of one embodiment of a configuration interface 200 in accordance with the invention. The configuration interface 200 presents user 103 with numerous options from which to pick to create his or her display 20. The embodiment shown allows a user 103 to create displays 20 to be produced as previously described, i.e., discs to be inserted into a cap for a riflescope, but on a piece by piece basis. The invention may also allow users 103 to configure and produce DOPE charts of other shapes and sizes as well. For example, the system 90 could be used to configure and produce traditional DOPE log book pages, rectangular DOPE charts, or any other suitable shape. In other words, the shape or material of the media on which the display 20 produced may be any suitable shape or size without departing from the invention. Selecting displays 20 of other shapes or sizes could be offered as one of the options presented to user 103 on the configuration interface 200.

As shown in FIG. 19, user 103 may choose from a number of options including but not limited to whether a border 202 should be included on the display 20 or whether a user 103 would like to include additional graphics 204 around the DOPE chart itself. Additionally, user 103 may include custom text 205 that is placed at the top of the display 20. Such custom text could be anything user 103 wants to include on the display 20, including but not limited to the gun/ammunition combination associated with the display, a nickname, or any other identifying information. Although the embodiment shown includes a number of options from which a user 103 may select, more or fewer options may be offered to user 103 without departing from the invention.

Also as shown in FIGS. 19 and 20, user 103 is given the option of creating two common styles 206 of DOPE charts for the display 20: dropchart 208 and reticle 210. Of course, any other style options may be included without departing from the invention. After user 103 selects which style 206 of DOPE chart he or she prefers, a data entry chart 212 is presented to user 103 that corresponds to the selected style 206, which allows user 103 to input the DOPE information as he or she desires. As shown in FIG. 20, the data entry step may be done manually or the data entry chart 212 may be automatically populated using presently available ballistics calculators that may be stored on a ballistic calculator server 101 (see FIG. 15). In other embodiments, additional functionality may be included such as, but not limited to, generating certain environmental data such as coriolis, spin drift, temperature, barometric pressure, altitude, and relative humidity based on GPS coordinates or current weather data. Such data may be available from internet based providers, may be manually entered, or may also be generated by any other suitable means. In such an embodiment, a shooter could foreseeably configure, order, and pick up a custom DOPE display 20 just before going out to shoot.

Figure 21:
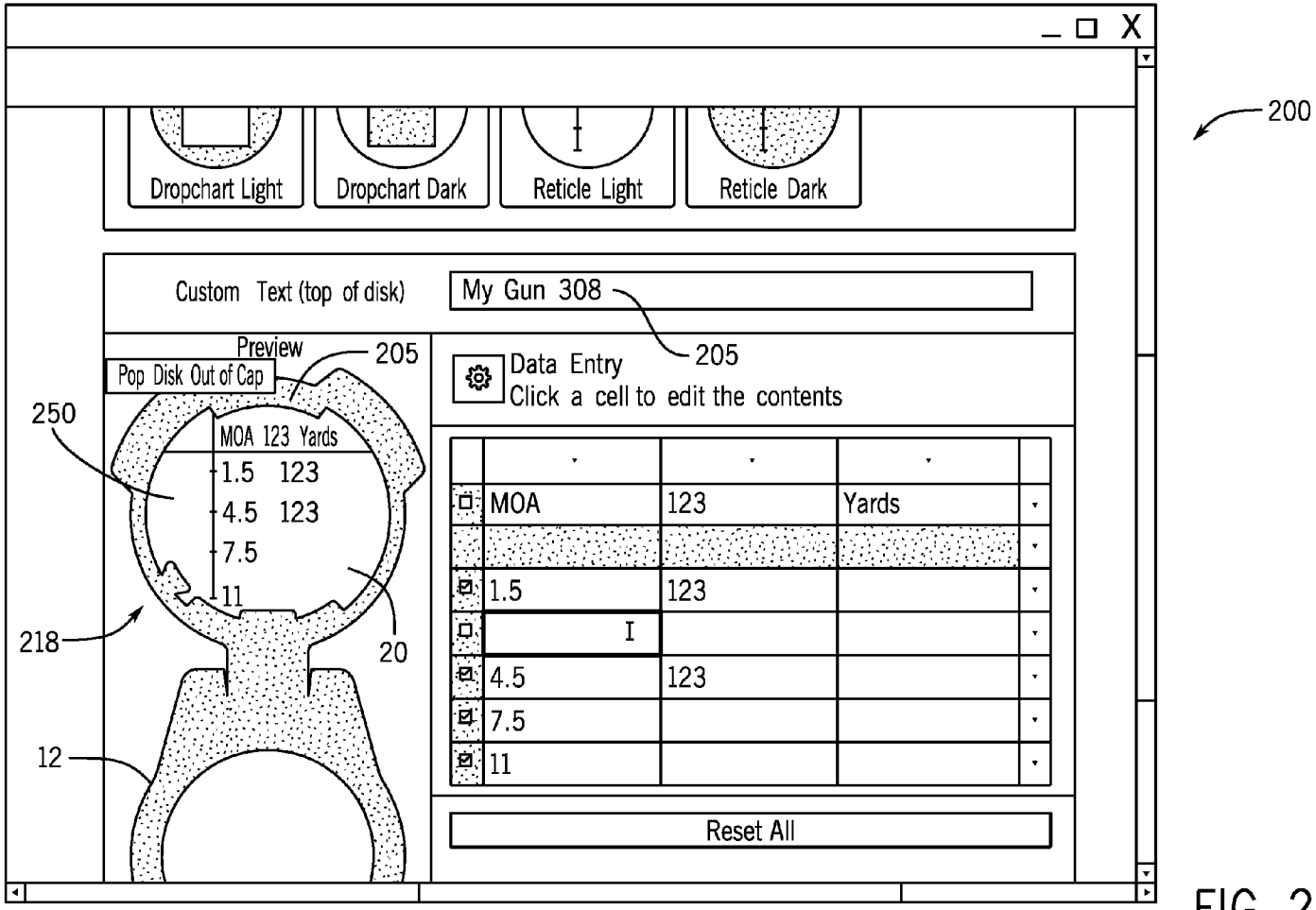
FIG. 21 is a schematic of the configurator interface of FIG. 16 showing the data entry table for a reticle style DOPE chart.
Figure 22:
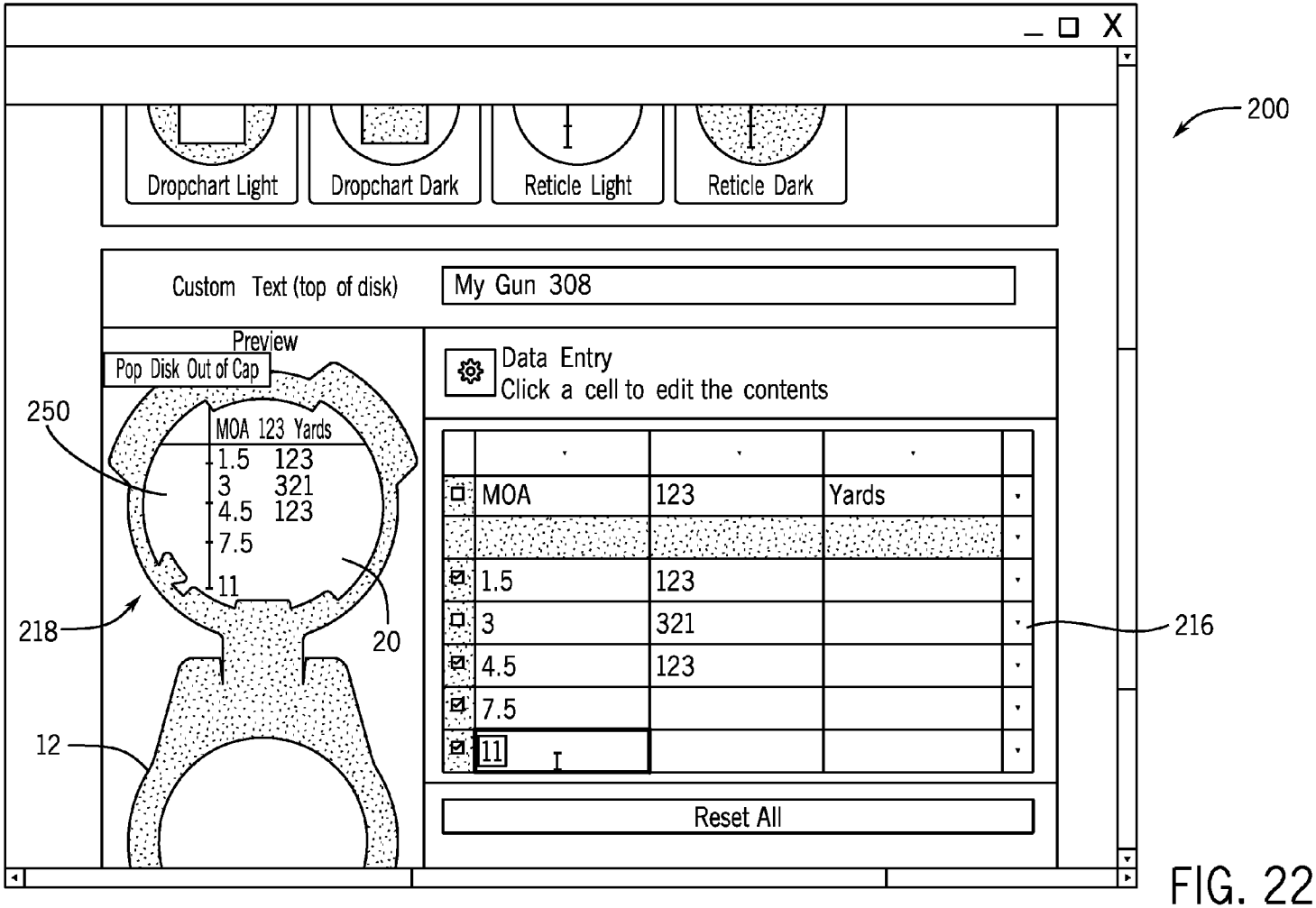
FIG. 22 is a schematic of the configurator interface of FIG. 18 showing the addition of a row to the reticle style DOPE chart.
Figure 23:
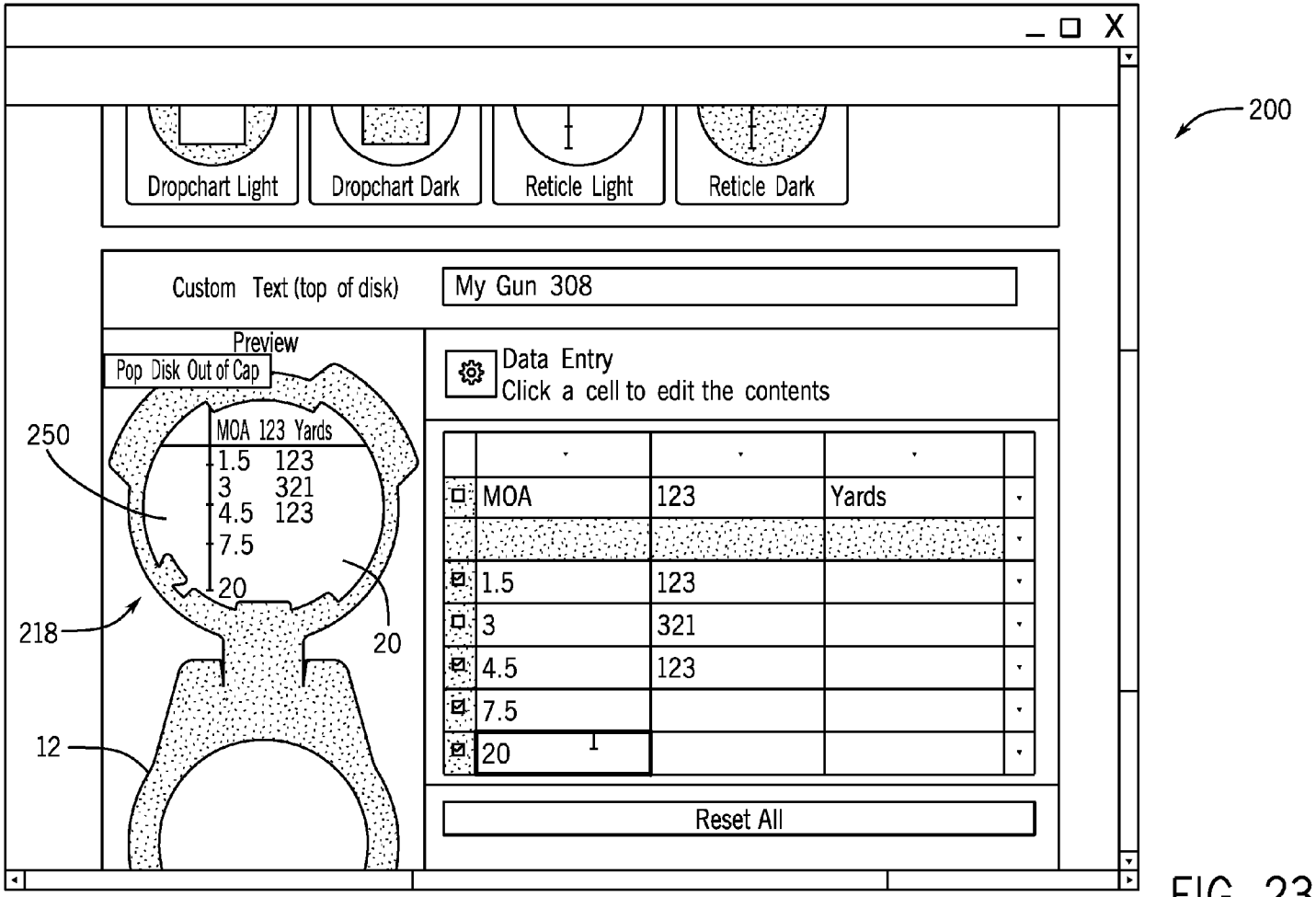
FIG. 23 is a schematic of the configurator interface of FIG. 18 showing the proportional display of MOA value on the reticle style DOPE chart.
Figure 24:
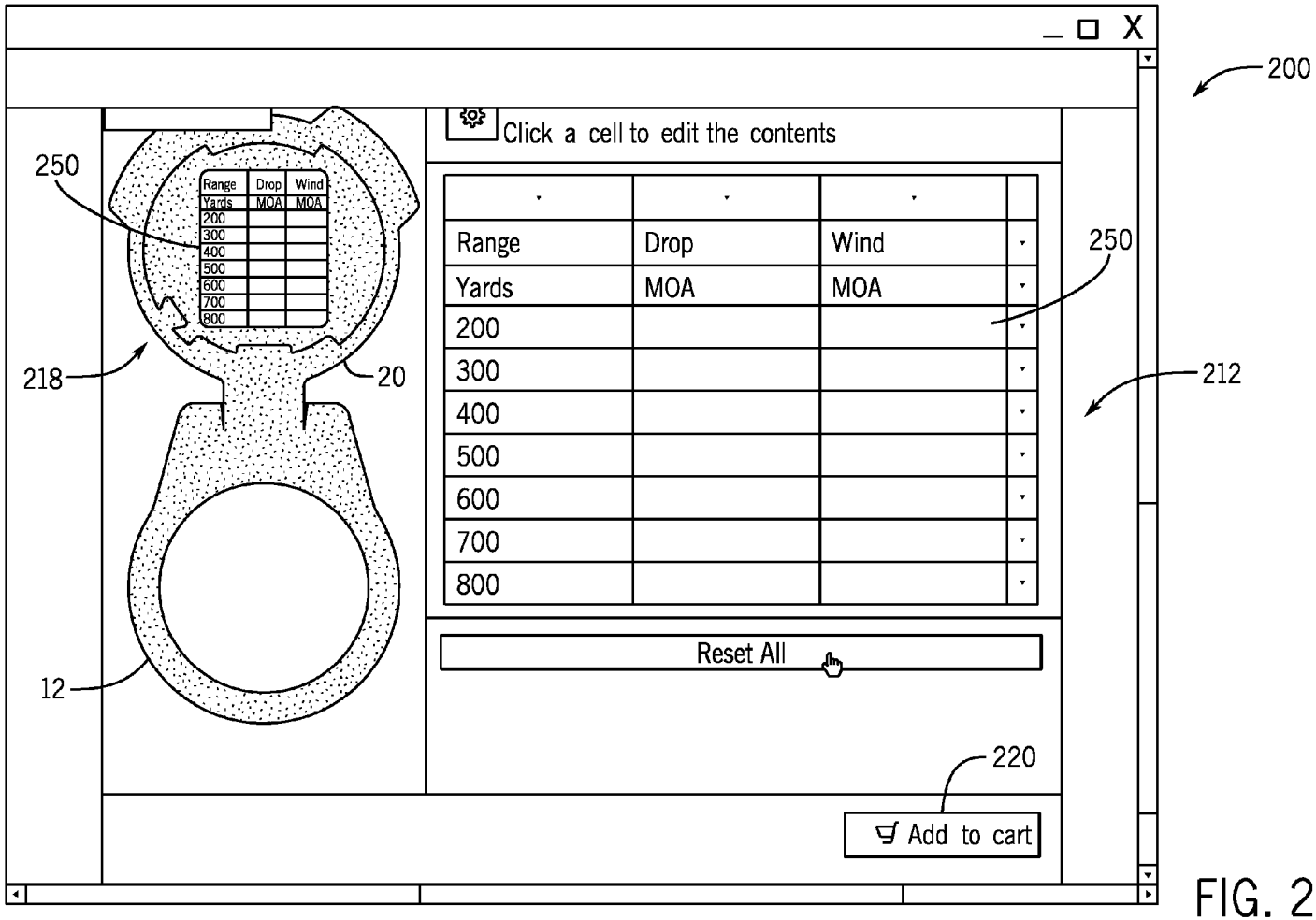
FIG. 24 is a schematic of the configurator interface of FIG. 18 showing an "add to cart" button.

The data entry chart 212 is highly customizable as well. As shown in FIG. 20, user 103 can add and/or delete columns 214 and/or rows 216 to configure the DOPE chart exactly how he or she desires. As user 103 customizes the data entry chart 212, a real-time preview 218 of the display 20 is shown to user 103. If user 103 has selected the reticle 210 style DOPE chart, the MOA data included in the chart is shown so that the values are proportional to each other. For example, as shown in FIG. 21, the MOA column is shown having values from 0-11, with markings at 1, 4.5, and 7.5 spaced in between. As shown in FIG. 22, user 103 has added a row 216 with an MOA value of 3, which is now displayed on the real-time preview 218. As shown in FIG. 23, user 103 has now replaced the top MOA value of 11 with a value of 20, but left the other markings the same. What has happened is the existing markings at 1.5, 3, 4.5, and 7.5 have moved up so that the new top MOA value of 20 can be shown proportionally. Existing reticle charts and other DOPE charts do not easily allow for a proportional display of MOA values. As shown in FIG. 24, an "add to cart" button 220 is included at the bottom of the configuration interface 200 that allows user 103 to initiate the purchase process described above.

Once user 103 orders display 20, the producer prints the DOPE chart configuration on the DOPE chart 250 onto a blank DOPE disk. In the embodiment shown, a printer 105 prints directly onto the blank disk using an Epilog Mini, Helix, or other suitable printer. In alternative embodiments, the producer could provide blank disks and label sheets that user 103 could use to print the display 20 on their home printer, which he or she could then stick to the blank disk.

Figure 25:
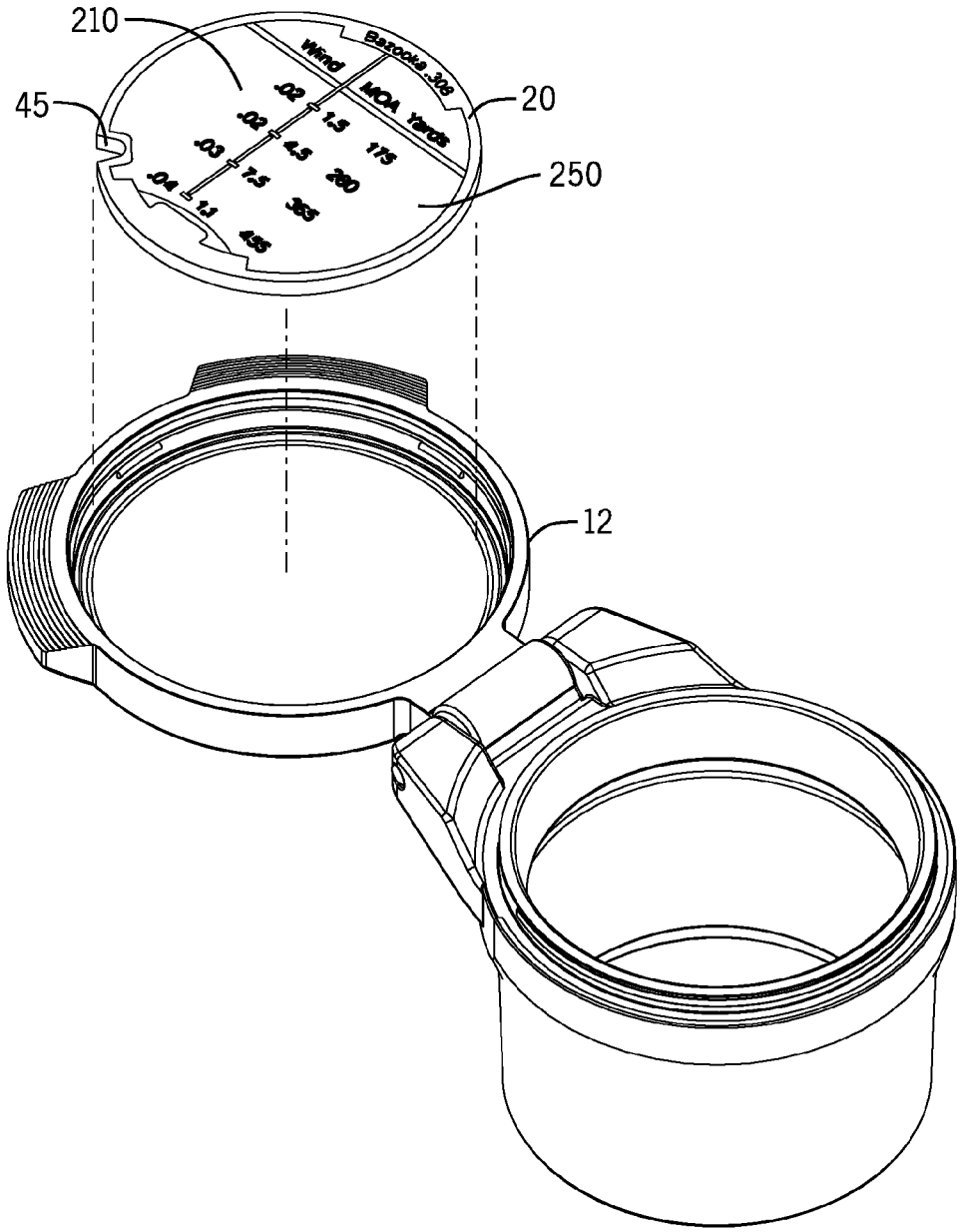
FIG. 25 is an isometric view of another embodiment of an optic cover showing the cap open and the display removed.
Figure 26:
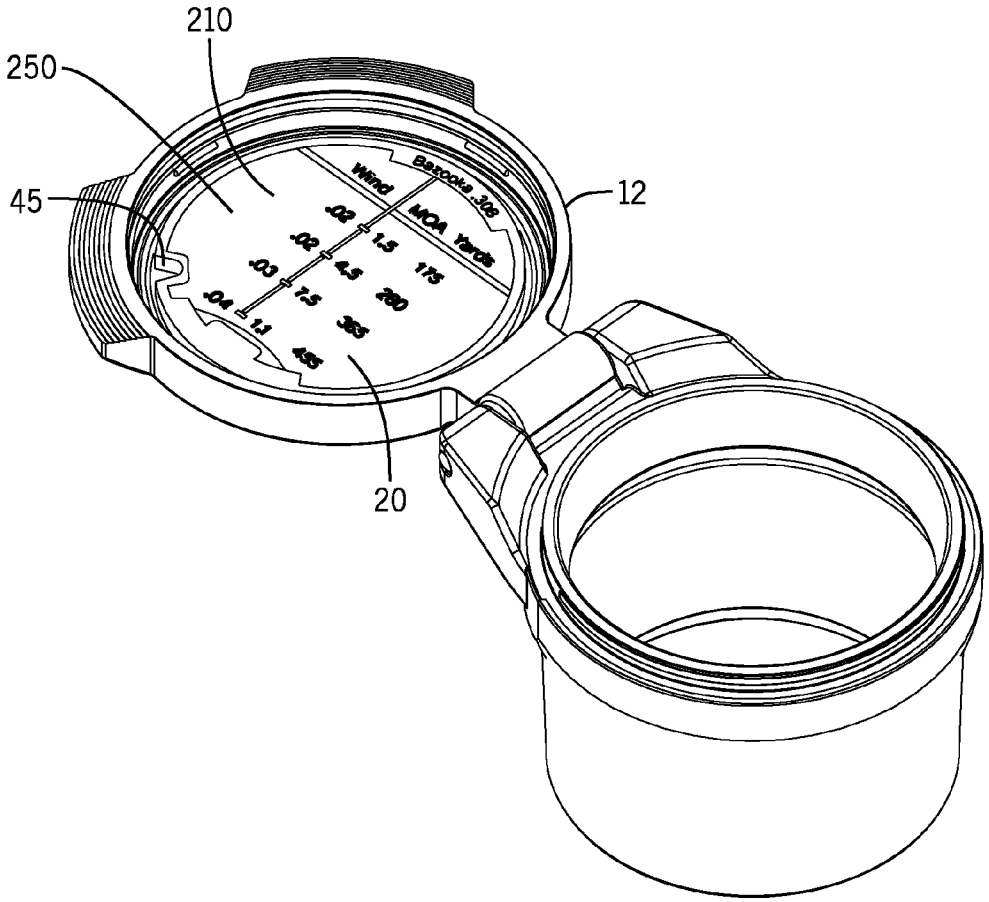
FIG. 26 is another isometric view of the optic cover of FIG. 24 showing the cap open and a reticle style display inserted into the cap.
Figure 27:
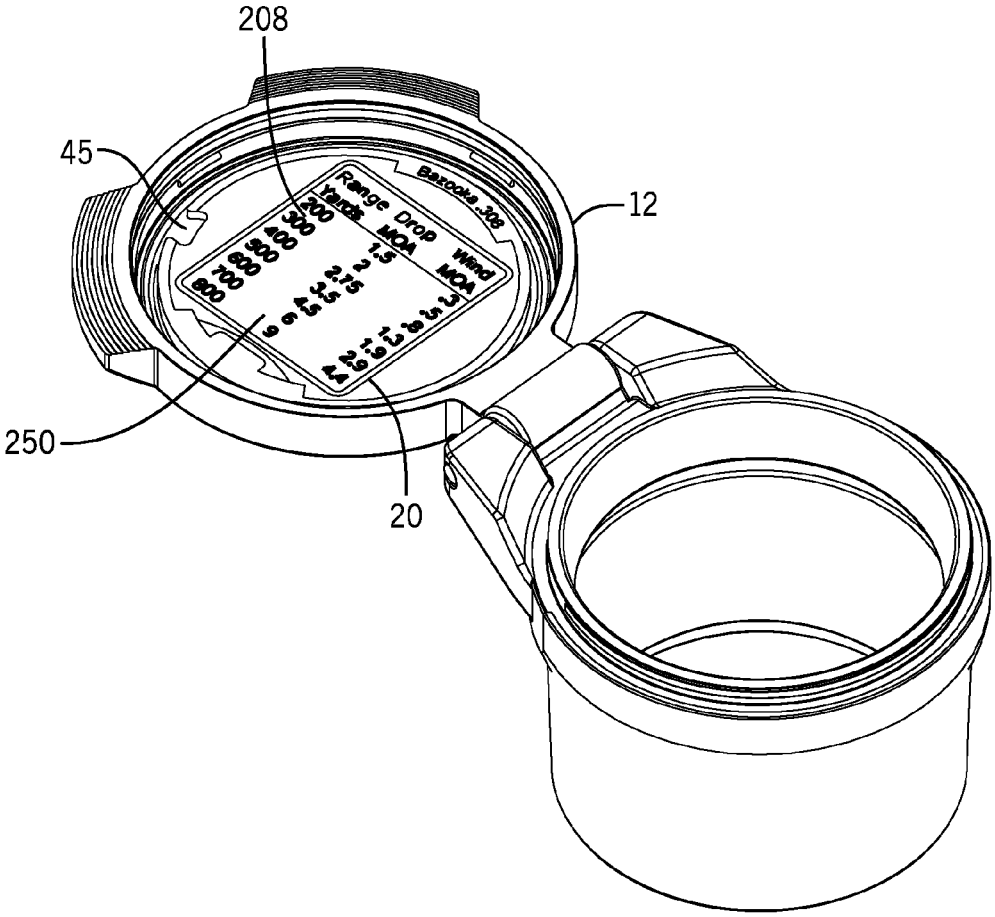
FIG. 27 is another isometric view of the optic cover of FIG. 24 showing the cap open and a dropchart style display inserted into the cap.

FIGS. 25-27 show embodiments of DOPE charts 250 shown separate from and inserted into covers 10 and specifically caps 12. As shown in FIG. 25, display 20 includes one recess 45 that allows user 103 to selectively remove the display from cap 12, for example by using the tip of a pen or other small tool. Exemplary displays are shown in FIGS. 26-27. The display 20 shown in FIGS. 25 and 26 are reticle style DOPE charts 210, while FIG. 27 shows a dropchart style DOPE chart 208.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A method for producing a DOPE chart for insertion into an optic cover cap of an optical device, the optic cover cap having a generally round interior portion, the method comprising:

providing a configuration interface on a user computer;

providing at least one server for storing and processing data for the configuration interface;

selecting one of a plurality of available DOPE chart styles;

entering at least one desired DOPE value into a DOPE chart configuration table displayed on the configuration interface; and producing a generally round display, wherein the display includes the DOPE chart, and further wherein the display has a first layer and a second layer and the first layer is a different color than the second layer.

2. The method of claim 1, wherein the at least one desired DOPE values are automatically generated from a database of DOPE values.

3. The method of claim 2, wherein the database of DOPE values is stored on a server.

4. The method of claim 1, further including the step of selecting from at least one graphic to be included on the DOPE chart.

5. The method of claim 1, further including the step of generating and displaying a real-time preview of the DOPE chart on the configuration interface.

6. The method of claim 5, wherein the real-time preview is updated using a debounce code.

7. The method of claim 5, wherein the real-time preview is updated periodically.

8. The method of claim 5, wherein the real-time preview is a three dimensional rendering that may be manipulated by a user.

9. The method of claim 1, further including the step of entering custom text on the DOPE chart.

10. The method of claim 1, further including the step of automatically generating at least one of the DOPE values based on current environmental conditions obtained from an internet based weather database.

11. The method of claim 1, wherein the display has a perimeter that includes at least one indent formed into the perimeter such that the display may be released from the optic cover cap.

12. The method of claim 1, further including the step of purchasing the display using an e-commerce system.

13. The method of claim 1, further including the step of inserting the display into an optic cover cap.

14. The method of claim 1, wherein the interior portion of the optic cover cap includes at least one structure configured to engage the display and the display has a generally round shape substantially configured to engage the at least one structure, wherein the at least one structure is selected from the group consisting of a tab, an annular ridge, ring or flange, a post, a magnet, and combinations thereof.

15. The method of claim 1, wherein the display has a third layer.

16. A system of producing a DOPE chart for insertion into an optic cover cap of an optical device comprising;

a configuration interface displayed on a user computer;

a DOPE chart configuration database connected to the user computer including a plurality of options from which a user may select to create the DOPE chart; and a printer connected to the dope chart configuration database for printing the DOPE chart onto a medium having a shape conforming to an inner portion of the optic cover cap, wherein the medium has a first layer and a second layer and the first layer is a different color than the second layer.

17. The system of claim 16 wherein the DOPE chart configuration database is stored on a server connected to the user computer via the internet.

18. The system of claim 16 wherein the printer is an engraver.

19. The system of claim 16, wherein the display has a third layer.

20. A method for producing a DOPE chart for insertion into an optic cover cap of an optical device comprising:

entering at least one desired DOPE value from a database of DOPE values stored on a server into a DOPE chart configuration table displayed on a configuration interface of a user computer; and producing a generally round display having a shape conforming to an inner portion of the optic cover cap, wherein the display includes the DOPE chart, and further wherein the display has a first layer and a second layer and the first layer is a different color than the second layer.

21. The method of claim 20, wherein the display includes at least one indent formed into a perimeter of the display such that the display may be released from the optic cover cap.

22. The method of claim 20, wherein the display has a third layer.

* * * * *